US011777223B2

(12) United States Patent
Goussetis et al.

(10) Patent No.: US 11,777,223 B2
(45) Date of Patent: Oct. 3, 2023

(54) MEANDERED SLOTTED WAVEGUIDE FOR A LEAKY WAVE ANTENNA, AND A LEAKY WAVE ANTENNA

(71) Applicant: Heriot-Watt University, Edinburgh Lothian (GB)

(72) Inventors: George Goussetis, Edinburgh Lothian (GB); Carolina Mateo-Segura, Edinburgh Lothian (GB); Samuel Rotenberg, Edinburgh Lothian (GB); Symon Podilchak, Edinburgh Lothian (GB); Constantin Constantinides, Edinburgh Lothian (GB)

(73) Assignee: HERIOT-WATT UNIVERSITY, Edinburgh Lothian (GB)

( * ) Notice: Subject to any disclaimer, the term of this patent is extended or adjusted under 35 U.S.C. 154(b) by 89 days.

(21) Appl. No.: 17/046,168

(22) PCT Filed: Apr. 8, 2019

(86) PCT No.: PCT/GB2019/051018
§ 371 (c)(1),
(2) Date: Oct. 8, 2020

(87) PCT Pub. No.: WO2019/197810
PCT Pub. Date: Oct. 17, 2019

(65) Prior Publication Data

US 2021/0075118 A1 Mar. 11, 2021

(30) Foreign Application Priority Data

Apr. 9, 2018 (GB) ..... 1805855

(51) Int. Cl.
*H01Q 13/20* (2006.01)
*H01P 1/18* (2006.01)
(Continued)

(52) U.S. Cl.
CPC ..... *H01Q 13/20* (2013.01); *H01P 1/182* (2013.01); *H01P 5/04* (2013.01); *H01P 9/006* (2013.01); *H01Q 3/32* (2013.01)

(58) Field of Classification Search
CPC ..... H01Q 13/20; H01Q 3/32; H01P 1/182; H01P 9/006; H01P 5/04; H01P 1/06; H01P 9/00
See application file for complete search history.

(56) References Cited

U.S. PATENT DOCUMENTS 2,437,067 A 3/1948 Bingley
3,108,237 A 10/1963 Reuvers et al.
(Continued)

FOREIGN PATENT DOCUMENTS

FR 2954596 A1 6/2011
JP S6072301 A 4/1985
(Continued)

OTHER PUBLICATIONS

Search Report in GB1805855.2 dated Sep. 5, 2018.
International Search Report mailed in PCT/GB2019/051018 dated Jul. 2, 2019.

*Primary Examiner* — Ricardo I Magallanes
*Assistant Examiner* — Yonchan J Kim
(74) *Attorney, Agent, or Firm* — Fox Rothschild LLP; Carol Thorstad-Forsyth

(57) ABSTRACT

A waveguide 200 for a leaky wave antenna 20 is described. The waveguide 200 comprises a male member 210 (210A-210T) and a corresponding female member 220 (220A-220T) arranged to receive the male member 210 (210A-210T) therein. The waveguide is arrangeable in a first configuration and a second configuration. The male member 210 (210A-210T) is received in the female member 220 (220A-220T) spaced apart therefrom in the first configuration and the second configuration. The first configuration
(Continued)

defines a first effective delay line. The second configuration defines a second effective delay line. The first effective delay line is different from the second effective delay line. The leaky wave antenna 20 is also described.

16 Claims, 26 Drawing Sheets

(51) Int. Cl.

| | |
|---|---|
| ***H01P 9/00*** | (2006.01) |
| ***H01Q 3/32*** | (2006.01) |
| ***H01P 5/04*** | (2006.01) |

(56) References Cited

U.S. PATENT DOCUMENTS

| | | | | |
|---|---|---|---|---|
| 5,910,754 | A * | 6/1999 | Simpson | H01P 5/04 333/17.3 |
| 7,646,268 | B1 * | 1/2010 | Tsironis | H01P 5/04 333/263 |
| 9,112,250 | B1 * | 8/2015 | Tsironis | H01P 1/22 |
| 2002/0101386 | A1 | 8/2002 | Takenoshita | |
| 2003/0016097 | A1 * | 1/2003 | McKinzie, III | H01Q 3/2682 333/161 |
| 2004/0246175 | A1 | 12/2004 | Thomas | |
| 2011/0187614 | A1 | 8/2011 | Kirino et al. | |
| 2012/0098619 | A1 | 4/2012 | Oo et al. | |
| 2017/0077576 | A1 | 3/2017 | Kirino | |
| 2019/0229418 | A1 * | 7/2019 | Yokokawa | H01Q 3/32 |

FOREIGN PATENT DOCUMENTS

| | | | |
|---|---|---|---|
| WO | 2007073638 | A1 | 7/2007 |
| WO | 2008081807 | A1 | 7/2008 |

* cited by examiner f = 20 Ghz θ = +50°
Realized gain = 12.4 dBi
Directivity = 14.6 dBi f = 20 Ghz θ = +50°
Realized gain = 13.4 dBi
Directivity = 16.3 dBi Frequency = 31 Ghz
Main lobe magnitude = 15.2
Main lobe direction = -64.0 deg.
Angular width (3 dB) = 24.9 deg.
Side lobe level = -9.2 dB Frequency = 31 Ghz
Main lobe magnitude = 15.7
Main lobe direction = 64.0 deg.
Angular width (3 dB) = 25.3 deg.
Side lobe level = -11.4 dB

MEANDERED SLOTTED WAVEGUIDE FOR A LEAKY WAVE ANTENNA, AND A LEAKY WAVE ANTENNA

CROSS REFERENCE TO RELATED APPLICATIONS

This application is a § 371 national phase entry of International Patent Application No. PCT/GB2019/051018, filed Apr. 8, 2019, which claims priority to and the benefit of Great Britain Patent Application No. 1805855.2 filed on Apr. 9, 2018, the disclosures of which are hereby incorporated herein by reference in their entireties.

FIELD

The present invention relates to waveguides and to antennas comprising such waveguides. Particularly, the present invention relates to meandered waveguides and to leaky-wave antennas comprising such waveguides.

BACKGROUND TO THE INVENTION

Typically, rectangular metallic waveguides are used as guiding structures in radio frequency (RF) systems. For example, these waveguides may be used for feeding networks for large antenna arrays or for low-profile beam steerable antennas for satellite communication systems.

In order to provide for portability and/or for mobile applications, miniaturized RF systems are required. For these miniaturized RF systems, linear travelling antennas and leaky-wave antennas (LWAs) combined with planar technology, for example microstrip, or waveguide technology have been proposed. These linear travelling antennas and leaky-wave antennas may have relatively simple, low profile structures and may provide relatively large high gain apertures. However, these linear travelling antennas and leaky-wave antennas are inherently associated with beam squint, whereby a beam scans as a beam frequency is varied.

For some applications where a narrow frequency band is required, such as for satellite communication systems, fixed-frequency operation is desirable (i.e. fixed beam frequency). However, for satellite on the move (SOTM) applications, beam steering, at a fixed beam frequency, is required in order to track a particular satellite. In more detail, in order to track a target such as a satellite for example, beam steering is required, for example 1D or 2D beam steering in the elevation plane (also known as elevation) and/or in the azimuthal plane (also known as azimuth). Beam steering may be provided by various methods, for example, using phase shifters, composite right-/left-handed (CRLH) transmission-line (TL) metamaterials, ferroelectric materials and/or ferromagnetic materials. As described below, phase shifters may be costly and/or complex. In addition, a beam scanning range provided using CRLH metamaterials, ferroelectric materials and/or ferromagnetic materials may be relatively limited. For example, for antennas based on ferroelectric materials and/or ferromagnetic materials, permittivities and/or permeabilites of these materials must be modified by applying external bias fields, for example DC electric fields but modifications to the permittivities and/or the permeabilites achieved in this way is limited. Furthermore, these methods may not be suitable for applications that require fast reconfiguration rates.

For example, phase shifters may be required for each radiating element. For example, 2D linear travelling antennas and 2D leaky wave antennas may be implemented as arrays of 1D waveguides (also known as leaky transmission lines). The waveguides may be fed by a manifold and beam steering, in the elevation and in the azimuth, may be provided by phase shifters arranged between the manifold and each radiating element. This results in significant cost and complexity, particularly for Ka-band (30 GHz) antennas suitable for satellite on the move applications where the total aperture size is very large, requiring approximately 4,000 phase shifters. Alternatively, fixed frequency backward to forward scanning capabilities (i.e. 1D beam steering in the elevation plane) may be provided by composite right- and left-handed (CRLH) metamaterials. However, these CRLH metamaterials may be based on ferrite structures or ferroelectric (FE) substrates, which may not be suitable for some applications. Furthermore, a beam scanning range may be relatively small.

Hence, there is a need to improve waveguides and antennas comprising such waveguides.

SUMMARY OF THE INVENTION

It is one aim of the present invention, amongst others, to provide a waveguide and an antenna comprising such a waveguide that at least partially obviates or mitigates at least some of the disadvantages of the prior art, whether identified herein or elsewhere. For instance, it is an aim of embodiments of the invention to provide a waveguide that is suitable for an antenna that provides beam steering, at a fixed beam frequency, at a lower cost and/or complexity and/or improves a scanning range, as well as providing a solution that is easily scalable to other frequency ranges. For instance, it is an aim of embodiments of the invention to provide an antenna that provides beam steering, at a fixed beam frequency, at a lower cost and/or complexity and/or improves a scanning range.

According to a first aspect, there is provided a waveguide for a leaky wave antenna, the waveguide comprising:

a male member; and a corresponding female member arranged to receive the male member therein;

wherein the waveguide is arrangeable in a first configuration and a second configuration;

wherein the male member is received in the female member spaced apart therefrom in the first configuration and the second configuration;

wherein the first configuration defines a first effective delay line;

wherein the second configuration defines a second effective delay line; and wherein the first effective delay line is different from the second effective delay line.

According to a second aspect, there is provided a leaky wave antenna comprising:

a first waveguide according to the first aspect; and a first actuator arranged to move the first waveguide from the first configuration to the second configuration;

wherein the antenna is arranged to scan a beam having a predetermined frequency in an elevation plane by actuating the first actuator, thereby moving the first waveguide from the first configuration to the second configuration.

According to a third aspect, there is provided a method of controlling a leaky wave antenna according to the second aspect to scan a beam having a predetermined frequency in an elevation plane, the method comprising:

actuating the first actuator, thereby moving the first waveguide from the first configuration to the second configuration.

According to a fourth aspect, there is provided a method of controlling a leaky wave antenna according to the second aspect to scan a beam having a predetermined frequency in an elevation plane and an azimuthal plane, the method comprising:

actuating the first actuator, thereby moving the first waveguide from the first configuration to the second configuration; and adjusting the first phase shifter thereby controlling the phase difference between the first waveguide and the second waveguide.

DETAILED DESCRIPTION OF THE INVENTION

According to the present invention there is provided a waveguide, an antenna comprising such a waveguide and a method of controlling such an antenna, as set forth in the appended claims. Other features of the invention will be apparent from the dependent claims, and the description that follows.

Throughout this specification, the term "comprising" or "comprises" means including the component(s) specified but not to the exclusion of the presence of other components. The term "consisting essentially of" or "consists essentially of" means including the components specified but excluding other components except for materials present as impurities, unavoidable materials present as a result of processes used to provide the components, and components added for a purpose other than achieving the technical effect of the invention, such as colourants, and the like.

The term "consisting of" or "consists of" means including the components specified but excluding other components.

Whenever appropriate, depending upon the context, the use of the term "comprises" or "comprising" may also be taken to include the meaning "consists essentially of" or "consisting essentially of", and also may also be taken to include the meaning "consists of" or "consisting of".

The optional features set out herein may be used either individually or in combination with each other where appropriate and particularly in the combinations as set out in the accompanying claims. The optional features for each aspect or exemplary embodiment of the invention, as set out herein are also applicable to all other aspects or exemplary embodiments of the invention, where appropriate. In other words, the skilled person reading this specification should consider the optional features for each aspect or exemplary embodiment of the invention as interchangeable and combinable between different aspects and exemplary embodiments.

According to the first aspect, there is provided a waveguide for a leaky wave antenna, the waveguide comprising:

a male member; and a corresponding female member arranged to receive the male member therein;

wherein the waveguide is arrangeable in a first configuration and a second configuration;

wherein the male member is received in the female member spaced apart therefrom in the first configuration and the second configuration;

wherein the first configuration defines a first effective delay line;

wherein the second configuration defines a second effective delay line; and wherein the first effective delay line is different from the second effective delay line.

In this way, scanning of a beam by the leaky wave antenna, for example at a predetermined frequency, for example a fixed-frequency, radiated by the waveguide may be controlled by moving the waveguide from the first configuration to the second configuration, since the effective delay lines in these two configurations are different thereby resulting in radiation of the beam at different elevation angles, for example. In this way, cost and/or complexity may be reduced, since fewer active RF components may be required compared with conventional RF systems.

In this way, beam steering may be provided for the leaky wave antenna operating at a fixed frequency, by moving the waveguide from the first configuration to the second configuration, for example by changing mechanical dimensions of the waveguide. Changing mechanical dimensions of the waveguide may be relatively simple and at lower cost while electrical performance of the leaky wave antenna may be improved. The leaky wave antenna may thus be suitable for satellite on-the-move applications, for broadband connection on mobile platforms, for example airplanes, trains, coaches and cars, particularly where having a low profile is important e.g. aerodynamic concerns or portability. Other applications include millimeter wave cellular systems, which are likely to have operating frequencies in the Ka-band.

The waveguide (also known as a guide) is for a leaky wave antenna (LWA) (also known as a fast-wave antenna). That is, the waveguide is suitable for radiating at least a part of a beam transmitted by the LWA. Generally, LWAs are a type of traveling wave antenna, in which radiation is due to a traveling wave on a guiding structure (i.e. a waveguide). Traveling-wave antennas include slow-wave antennas and fast-wave antennas. The traveling wave on a LWA is a fast wave, having a phase velocity greater than the speed of light. Fast waves radiate continuously along their lengths. Highly directive beams at an arbitrary specified angle may be provided by LWAs, with low sidelobe levels. The phase constant $\beta$, of the wave controls the beam pointing angle, while the attenuation constant $\alpha$ controls the beamwidth. LWAs may be uniform or periodic, depending on the type of guiding structure. A uniform LWA structure has a constant cross section along the length of the structure, usually in the form of a waveguide that has been partially opened to permit radiation. The guided wave on the uniform structure is a fast wave, and thus radiates as it propagates. A periodic LWA structure is one that has of a uniform structure that supports a slow (non radiating) wave that has been periodically modulated. Since a slow wave radiates at discontinuities, the periodic modulations (discontinuities) cause the wave to radiate continuously along the length of the structure. The periodic modulation creates a guided wave that consists of an infinite number of space harmonics (Floquet modes). Although the main ($n=0$) space harmonic is a slow wave, one of the space harmonics (usually the $n=-1$) is designed to be a fast wave, and this harmonic wave is the radiating wave.

In one example, the waveguide is a slotted waveguide, for example an air-filled rectangular waveguide having a longitudinal slot (i.e. aperture). This one-dimensional (1D) leaky-wave aperture distribution results in a 'fan beam' having a narrow shape in the xz plane (H plane), and a broad shape in the cross-plane. A 'pencil beam' may be created by using an array of such slotted waveguides.

In one example, the waveguide is a Non-Radiative Dielectric waveguide (NRD). NRD waveguides typically comprise a dielectric arranged between metal plates and are low-loss open waveguides for millimeter waves.

In one example, the waveguide is a groove waveguide. Groove waveguides are similar to NRD waveguides, having an air gap rather than a dielectric, and are low-loss open waveguides for millimeter waves.

In one example, the waveguide is a stepped waveguide (also known as a ridge waveguide). Stepped waveguides are asymmetric, based on a ridge or stepped structure rather than a rectangular structure.

The waveguide comprises the male member and the corresponding female member arranged to receive the male member therein. That is, the male member and the female member have corresponding shapes, for example. In one example, the male member comprises and/or is a convex shape (i.e. a protuberance) and the female member comprises and/or is a concave shape (i.e. a recess). In one example, the male member comprises and/or is a linear male member, for example a rod, and the female member comprises and/or is a corresponding linear female member, for example an aperture or passageway, arranged to receive the linear male member therein. In this way, the linear male member may translate linearly within (i.e. move axially in and out of) the linear female member, for example. In one example, the male member comprises and/or is a planar male member, for example a plate (also known as a leaf), and the female member comprises and/or is a corresponding planar female member, for example a slot, arranged to receive the planar male member therein. In this way, the planar male member may translate planarly within (i.e. move in a plane in and out of and/or up and down in) the planar female member. In one example, the female member is arranged to receive the male member wholly therein. In one example, the female member is arranged to receive the male member partly therein.

In one example, the waveguide comprises a plurality of male members. In one example, the waveguide comprises a plurality of corresponding female members. In one example, the waveguide comprises a plurality of male members and a plurality of corresponding female members arranged to receive the plurality of male members therein, respectively. In this way, an efficiency and/or power output of the waveguide may be improved. In one example, the waveguide comprises a plurality N of male members, wherein N is a natural number (i.e. a positive integer greater than 0). In one example, the waveguide comprises a plurality M of corresponding female members, wherein M is a natural number (i.e. a positive integer greater than 0). In one example, the waveguide comprises a plurality N of male members and a plurality M of corresponding female members arranged to receive the plurality N of male members therein, respectively. In one example, N is equal to M. In one example, N and M are in a range from 2 to 100, preferably in a range from 5 to 50.

In one example, the waveguide is a meandered waveguide. In one example, the plurality of male members have equal lengths, are mutually equispaced and/or are mutually parallel. In one example, the plurality of female members have equal depths, are mutually equispaced and are mutually parallel.

In one example, the waveguide comprises at least one port (i.e. a feeding port or point), for example two ports or a pair of ports, preferably arranged at opposed ends of the waveguide.

In one example, the waveguide comprises a first part including one of a plurality of male members and a second part includes the remaining plurality of male members, wherein the first part is moveable, for example translatable, slideable, pivotable and/or rotatable, with respect to the second part. In one example, the first part includes about a first half, preferably a first half, of the plurality of male members and the second part includes about a second half, preferably a second half, of the plurality of male members. For example, the first part and the second part may respectively include alternate male members of the plurality of male members. In one example, the first half of the plurality of male members, for example odd-numbered alternate male members, extend away from the first part and the second half of the male members, for example even-numbered alternate male members, extend away from the second part. In one example, a first half of the plurality of female members, for example alternate female members, corresponding to the first half of the male members, are defined between adjacent males members of the second half, for example by regions between the adjacent males members of the second half. In one example, a second half of the female members, for example alternate female members, corresponding to the second half of the male members, are defined between adjacent males members of the first half, for example by regions between the adjacent males members of the first half. That is, the first half of the male members may be received in the corresponding first half of the female members defined by the opposed second half of the male members. In one example, the second half of the male members are received in the corresponding second half of the female members defined by the opposed first half of the male members. That is, the first half of the male members may intermesh or intersect with the second half of the male members, for example like two opposed combs or fingers of two opposed hands. A path traversing between the intermeshed male members thus describes a meander or a serpentine path or a boustrophedon. Hence, the waveguide may be moved from the first configuration to the second configuration by moving the first part relative to the second part. In this way, all meander line lengths are changed simultaneously by a same amount.

The waveguide is arrangeable in the first configuration and the second configuration. That is, the waveguide is moveable, in use, between the first configuration and the second configuration.

In one example, the waveguide is arranged to move from the first configuration to the second configuration by a movement, for example a translation, of the male member relative to the female member.

In one example, the translation is in a direction defined by a longitudinal axis of the male member and/or the female member.

The male member is received in the female member spaced apart therefrom in the first configuration and the second configuration. That is, the male member and the female member do not physically contact each other in the first configuration and the second configuration. In other words, a gap is defined and/or provided between the male member and the female member. That is, the gap isolates the male member from the female member and vice versa. In one example, the male member is received in the female member spaced apart therefrom by a gap in the first configuration and the second configuration. In one example, the gap is a constant (also known as a uniform) gap. That is, the gap between the male member and the female member is constant in the first configuration and/or the second configuration, such that different surface regions of the male member are spaced apart from corresponding surface regions of the female member by a same distance. In one example, the male member is received in the female member spaced apart therefrom by a first gap in the first configuration and by a second gap in the second configuration, wherein the first gap and the second gap are different. In one example, the gap is a non-constant (also known as a non-uniform) gap. That is, the gap between the male member and the female member is variable in the first configuration and/or the second configuration, such that different surface regions of the male member are spaced apart from corresponding surface regions of the female member by different distances. In one example, lateral and/or axial spacings between the male member received in the female member in the first configuration and in the second configuration are constant. In one example, lateral and/or axial spacings between the male member received in the female member in the first configuration and in the second configuration are non-constant. In one example, the gap comprises a fluid, for example a gas such as air and/or a liquid such as a liquid crystal, for example a nematic liquid crystal such as K15 (also known as 5CB or 4-Cyano-4'-pentylbiphenyl, available from REX Scientific, UK) or GT3-23001 (available from Merck KGaA, Germany). In one example, the gap is and/or comprises a microfluidic channel containing such a fluid wherein the first effective delay line and the second effective delay line are provided by flowing the fluid in the microfluidic channel. In one example, the gap comprises a solid, such as a parasitic slab as described below in more detail.

The first configuration defines the first effective delay line, the second configuration defines the second effective delay line and the first effective delay line is different from the second effective delay line.

It should be understood that an effective delay line thus characterises a dispersion (also known as a coupling) due to the male member and the female member and hence the waveguide. For example, for a meandered waveguide, the effective delay line may be the meander line, characterised by a length (also known as a stub length) thereof. In one example, the first effective delay line comprises and/or is a first meander line length and the second effective delay line comprises and/or is a second meander line length. Hence, scanning of the beam may be by changing the meander line length. The effective delay length may be determined, at least in part, by a wave path, for example a length thereof, defined by the waveguide, for example by the male member and the female member. In one example, the first effective delay line comprises and/or is a first wave path length and the second effective delay line comprises and/or is a second wave path length. Hence, scanning of the beam may be by changing the wave path length. Additionally and/or alternatively, the effective delay length may be determined, at least in part, by a width of the waveguide, for example by a spacing between the male and female member. For example, the waveguide width may be modified so that an overlap width, for example out of plane, of the male member and female member is modified while a spacing between the male member and female member remains constant. In one example, the first effective delay line comprises and/or is a first waveguide width and the second effective delay line comprises and/or is a second waveguide width. Hence, scanning of the beam may be by changing the waveguide width. Additionally and/or alternatively, the effective delay length may be determined, at least in part, by a permittivity of a region, for example a gap, an air gap, a parasitic slab, arranged between the male member and the female member. In one example, the first effective delay line comprises and/or is a first permittivity of the region and the second effective delay line comprises and/or is a second permittivity of the region. Hence, scanning of the beam may be by changing the permittivity of the region, for example using a tunable dielectric. In one example, the first effective delay line comprises and/or is a first position of a parasitic slab and the second effective delay line comprises and/or is a second position of the parasitic slab. Hence, scanning of the beam may be by changing the position of the parasitic slab. Additionally and/or alternatively, the effective delay length may be determined, at least in part, by a periodicity of the waveguide, for example due to a ridge. That is, a cut-off frequency of the waveguide may be controlled using a ridge and altering the dispersion of the mode by adding a reactive load using metals or other waveguide inclusions, including metasurface coverings inside the waveguide. In one example, the first effective delay line comprises and/or is a first periodicity of the waveguide and the second effective delay line comprises and/or is a second periodicity of the waveguide. Hence, scanning of the beam may be by changing the periodicity of the waveguide.

Generally, frequency-scanning antennas may be provided, for example, by a meandered transmission line feeding radiating elements at periodic junctions. The meandered transmission line is arranged such that within a given frequency range, the required phase difference between successive elements is achieved by appropriate electrical lengths between sequential radiating elements. Additionally, a spatial separation (periodicity) between the radiating elements provides array factors that scan 180°. Furthermore, the meandered transmission line exploits higher order Floquet Space Harmonics (FSHs) associated with periodic structures. After selecting the radiating FSH, the period of the meandered transmission line may be thus defined and hence the electrical length between successive radiating elements.

Conventionally, a phase shift between successive radiating elements may be obtained by changing the frequency. This, however, is not compatible with a requirement to operate at a fixed frequency. In order to provide beam scanning without changing the frequency, the waveguide is instead arrangeable in the first configuration and the second configuration, thereby providing varying phase shifts between the radiating elements and hence comparable with the phase shifts achieved with frequency scanning. For example, this beam scanning without changing the frequency may be achieved by changing the meander line length of a meandered (also known as a serpentine) transmission line in an air-filled waveguide. More generally, this beam scanning without changing the frequency may be achieved by changing the effective delay length i.e. from the first effective delay length to the second effective delay length. For the case of changing the meander line length, the beam scanning may be expressed by the following equations:

$$\beta_{variable\ frequency} \cdot \alpha'_{fixed} = \beta_{fixed\ frequency} \cdot \alpha'_{variable} \quad \text{Equation 1:}$$

$$\Phi_{variable\ frequency\ scanning} = \Phi_{fixed\ frequency\ scanning} \quad \text{Equation 2:}$$

where $\alpha'_{fixed}$ is a length of the meander line for conventional frequency scanning; the propagation constant $\beta_{variable\ frequency}$ varies as the frequency varies; the propagation constant $\beta_{fixed\ frequency}$ is determined by the operational frequency required, for example 20 GHz; $\Phi_{variable\ frequency\ scanning}$ is the phase shift achieved with conventional frequency scanning and depends solely on the propagation constant $\beta_{variable\ frequency}$. Hence, Equation (1) provides $\alpha'_{variable}$ which is the variable physical length of a meander line that will provide varying phase shift between radiating elements at a fixed frequency (right hand side of Equation 2) that matches the phase shift achieved with conventional frequency scanning (left hand side of Equation 2). The change in length required (i.e. the amount of movement needed) is determined by the minimum and maximum values of $\alpha'_{variable}$. In this way, variation of the length of the meander permits obtaining the beam steering at a fixed frequency. More generally, by changing the effective delay length, beam steering at a fixed frequency is provided by the waveguide.

In one example, the first effective delay line is based, at least in part, on a first meander line length and wherein the second effective delay line is based, at least in part, on a second meander line length, wherein the first meander line length is different from the second meander line length. In other words, scanning a beam is provided by changing a meander line length by moving the male member relative to the female member.

In one example, the waveguide comprises a parasitic slab arrangeable between the male member and the female member, wherein the first effective delay line is based, at least in part, on a first dispersion provided by a first position of the parasitic slab between the male member and the female member and wherein the second effective delay line is based, at least in part, on a second dispersion provided by a second position of the parasitic slab between the male member and the female member.

It should be understood that the parasitic slab comprises and/or is formed from a solid having a permittivity of at least 2, preferably at least 5, more preferably at least 10. In one example, the parasitic slab comprises and/or is a solid having a shape corresponding, at least in part, with a shape of a gap otherwise defined between the male member and the female member i.e. a volume defined between the male member and the female member. In one example, a fluid gap, for example an air gap, is arranged between the male member and the parasitic slab and/or between the female member and the parasitic slab.

In one example, the waveguide is arranged to move from the first configuration to the second configuration by a movement, for example a translation, of the parasitic slab relative to the male member and/or the female member. That is, the parasitic slab is moveable with respect to the male member and/or the female member. In one example, a position of one or two of the male member, the female member and the parasitic slab is fixed and a position of the other parts is moveable. For example, the positions of the male member and the female member may be fixed while the position of the parasitic slab is moveable, thereby changing the effective delay line from the first effective delay line to the second effective delay line. In other words, scanning a beam is provided by perturbing a transverse electric (TE) mode inside the waveguide and thus changing the first effective delay line to the second effective delay line.

In one example, the translation of the parasitic slab is in a direction transverse to a longitudinal axis of the male member and/or the female member. In one example, a spacing for example a gap between the male member and the parasitic slab and/or between the female member and the parasitic slab is constant during the translation.

In one example, the waveguide is a metallic waveguide. In one example, the waveguide is a metallic meandered waveguide.

In one example, a size of the waveguide is determined, at least in part, by the predetermined frequency. That is, the waveguide may be scalable for different predetermined frequencies.

In one example, the waveguide, for example radiating elements thereof, is arranged to radiate linear polarization (LP), vertical-LP (V-LP), horizontal-LP (H-LP), left-hand circular polarization (LHCP) and/or right-hand circular polarization (RHCP) beams by input feeding at different ends of the waveguide.

In one example, the waveguide comprises a radiating aperture. In one example, the radiating aperture is provided by a slot. In one example, the radiating aperture is provided by a PCB layer, thereby providing enhanced resolution of the radiating aperture. In one example, the PCB layer comprises a homogonized metasurface, for example a printed and sub-wavelength metallic pattern. In one example, the waveguide comprises a radiating aperture associated with the male member and the corresponding female member. In one example, the waveguide comprises a plurality of radiating apertures associated with the respective plurality of male members and the corresponding female members.

In one preferred example, there is provided the waveguide for the leaky wave antenna, the waveguide comprising:

the male member; and the corresponding female member arranged to receive the male member therein;

wherein the waveguide is arrangeable in the first configuration and the second configuration;

wherein the male member is received in the female member spaced apart therefrom in the first configuration and the second configuration;

wherein the first configuration defines the first effective delay line;

wherein the second configuration defines the second effective delay line; and wherein the first effective delay line is different from the second effective delay line, wherein the waveguide is a metallic meandered slotted waveguide;

wherein the first effective delay line is a first meander line length and wherein the second effective delay line is a second meander line length;

wherein the male member is a planar male member and wherein the female member is a planar female member;

wherein the waveguide comprises a plurality N of such male members and a plurality M of such corresponding female members arranged to receive the plurality N of male members therein, respectively;

wherein the waveguide is arranged to move from the first configuration to the second configuration by simultaneous translation of the plurality N of male members relative to the plurality M of female members.

The second aspect provides a leaky wave antenna comprising:

a first waveguide according to the first aspect; and a first actuator arranged to move the first waveguide from the first configuration to the second configuration;

wherein the antenna is arranged to scan a beam having a predetermined frequency in an elevation plane by actuating the first actuator, thereby moving the first waveguide from the first configuration to the second configuration.

Preferably, the first waveguide is according to the preferred example of the first aspect.

It should be understood that the predetermined frequency is a fixed frequency.

In this way, scanning of the beam by the leaky wave antenna at the predetermined frequency radiated by the waveguide may be controlled by causing the first actuator to move the waveguide from the first configuration to the second configuration, since the effective delay lines in these two configurations are different thereby resulting in radiation of the beam at different elevation angles, for example.

In this way, cost and/or complexity may be reduced, since fewer active RF components may be required compared with conventional RF systems.

In this way, the leaky wave antenna provides beam steering from the backward to the forward quadrant (i.e. in an elevation plane), at the predetermined frequency, while reducing the need for active, reconfigurable RF components. This may provide a compact structure that may enable significant cost reductions and improved antenna efficiency when compared to more conventional beam steering approaches.

In one example, the first waveguide is a meandered metallic waveguide, embedded within a cavity exploiting radiation from higher order Floquet space harmonics. Conventionally, this type of antenna works on a principle of frequency scanning, as described previously, where a shift of phase front is achieved by modification of the frequency (i.e. not a predetermined frequency). In contrast, the leaky wave antenna of the second aspect scans at a fixed frequency (i.e. the predetermined frequency), for example for operation in the Ka band. Scanning of the beam is achieved by moving the first waveguide from the first configuration to the second configuration, for example by mechanically modifying lengths of the waveguide meanders (for example simultaneously) and/or by adjusting the dispersion of the waveguide. In this way, a tunable phase variation between successive radiating elements may be provided thereby providing scanning of the beam.

In one example, the predetermined frequency is in a range from 5 GHz to 100 GHz, preferably in a range from 10 GHz to 50 Ghz, for example the Ku band from 12 GHz to 18 GHz, the K band from 18 GHz to 27 GHz for example 20 GHz and/or the Ka band from 27 GHz to 40 GHz, for example 31 GHz.

In one example, the leaky wave antenna comprises:

a second waveguide according to the first aspect; and a second actuator arranged to move the second waveguide from the first configuration to the second configuration;

wherein the antenna is arranged to scan the beam having the predetermined frequency in the elevation plane by actuating the second actuator, thereby moving the second waveguide from the first configuration to the second configuration.

The first waveguide and the second waveguide are as described with respect to the first aspect, preferably according to the preferred example.

The leaky wave antenna may be as described with respect to the first aspect.

In one example, first actuator and the second actuator are actuated simultaneously. In this way, respective lengths of the waveguide meanders and/or respective positions of the parasitic slabs may be modified simultaneously.

In this way, a scan range of 100° in the elevation plane may achieved by adjusting the respective lengths of the waveguide meanders i.e. a height of the cavity. Realised gain values higher than 10 dBi are observed. For example, realised gain values of 22 dBi at the predetermined frequency of 31 GHz may be obtained from simulations.

In one example, the first actuator and/or the second actuator comprises a micropusher and/or a threaded actuator, for example a screw. Examples of micropushers include linear actuators such as L-220 High-Resolution Linear Actuators available from Physik Instrumente Ltd (UK), having a travel range of from 13 mm to 77 mm. Other micropushers are known.

In one example, the antenna comprises a first phase shifter, for example a single first phase shifter, associated with the first waveguide, wherein the first phase shifter is arranged to control, at least in part, a phase difference between the first waveguide and the second waveguide whereby the antenna is arranged to scan the beam having the predetermined frequency in an azimuthal plane.

In one example, the antenna comprises a second phase shifter, for example a single second phase shifter, associated with the second waveguide, wherein the second phase shifter is arranged to control, at least in part, a phase difference between the first waveguide and the second waveguide whereby the antenna is arranged to scan the beam having the predetermined frequency in the azimuthal plane.

That is, only one phase shifter is required for each waveguide, since scanning of the beam in the elevation plane is provided by moving each waveguide from the first configuration to a second configuration while scanning of the beam is in the azimuthal plane is provided by the respective phase shifters. In contrast, scanning in conventional antennas requires a phase shifter for each radiating element and hence multiple phase shifters are required for each waveguide. In this way, a number of phase shifters is reduced, thereby reducing cost and complexity.

In one preferred example, the leaky wave antenna comprises:

the first waveguide according to the preferred example of the first aspect;

the second waveguide according to the preferred example of the first aspect; and the first actuator arranged to move the first waveguide from the first configuration to the second configuration;

a second actuator arranged to move the second waveguide from the first configuration to the second configuration;

wherein the first actuator is a micropusher and wherein the second actuator is a micropusher;

wherein the first actuator and the second actuator are actuatable simultaneously;

wherein the antenna is arranged to scan a beam having a predetermined frequency in an elevation plane by actuating the first actuator, thereby moving the first waveguide from the first configuration to the second configuration;

wherein the antenna is arranged to scan the beam having the predetermined frequency in the elevation plane by actuating the second actuator, thereby moving the second waveguide from the first configuration to the second configuration;

wherein the antenna comprises a single first phase shifter associated with the first waveguide, wherein the first phase shifter is arranged to control, at least in part, a phase difference between the first waveguide and the second waveguide whereby the antenna is arranged to scan the beam having the predetermined frequency in an azimuthal plane; and wherein the antenna comprises a single second phase shifter associated with the second waveguide, wherein the second phase shifter is arranged to control, at least in part, a phase difference between the first waveguide and the second waveguide whereby the antenna is arranged to scan the beam having the predetermined frequency in the azimuthal plane.

According to the third aspect, there is provided a method of controlling a leaky wave antenna according to the second aspect to scan a beam having a predetermined frequency in an elevation plane, the method comprising:

actuating the first actuator, thereby moving the first waveguide from the first configuration to the second configuration.

The method may include any of the steps described herein.

According to the fourth aspect, there is provided a method of controlling a leaky wave antenna according to the second aspect to scan a beam having a predetermined frequency in an elevation plane and an azimuthal plane, the method comprising:

actuating the first actuator, thereby moving the first waveguide from the first configuration to the second configuration; and adjusting the first phase shifter thereby controlling the phase difference between the first waveguide and the second waveguide.

The method may include any of the steps described herein.

BRIEF DESCRIPTION OF THE DRAWINGS

For a better understanding of the invention, and to show how exemplary embodiments of the same may be brought into effect, reference will be made, by way of example only, to the accompanying diagrammatic Figures, in which.

DETAILED DESCRIPTION OF THE DRAWINGS

Figure 1A:
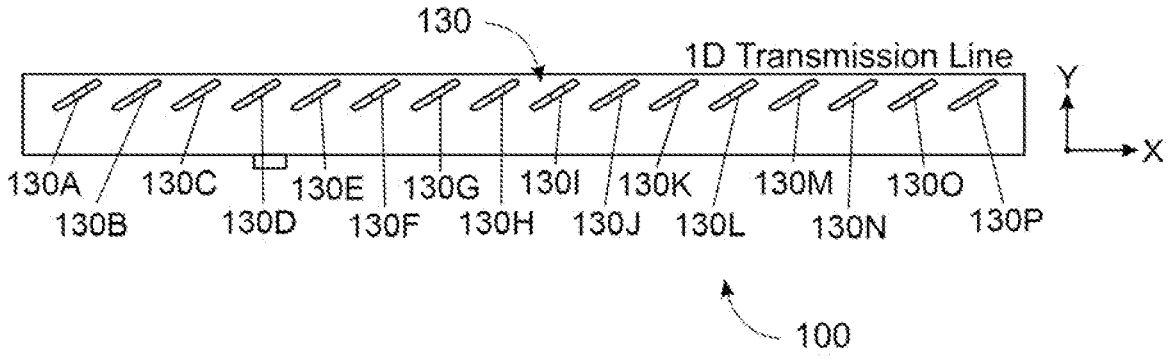
FIGS. 1A to 1B schematically depict a waveguide according to an exemplary embodiment.
Figure 1B:
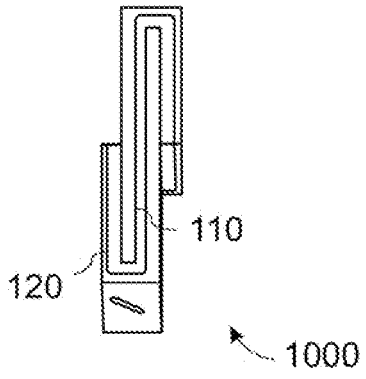

FIGS. 1A to 1B schematically depict a waveguide 100 according to an exemplary embodiment. Particularly, FIG. 1A shows a plan view of the waveguide 100 and FIG. 1B shows a perspective view of a unit element 1000 of the waveguide 100.

The waveguide 100 is for the leaky wave antenna 10. The waveguide 100 comprises a male member 110 and a corresponding female member 120 arranged to receive the male member 110 therein. The waveguide is arrangeable in a first configuration and a second configuration. The male member 110 is received in the female member 120 spaced apart therefrom in the first configuration and the second configuration. The first configuration defines a first effective delay line. The second configuration defines a second effective delay line. The first effective delay line is different from the second effective delay line.

In more detail, the waveguide 100 provides a 1D transmission line. In this example, the waveguide 100 is a meandered waveguide 100. The unit element 1000 represents $\alpha'_{variable}$ which is the variable physical length of a meander line of the waveguide 100 that will provide varying phase shift between radiating elements at a fixed frequency.

In this example, the plurality of male members 110 have equal lengths, are mutually equispaced and are mutually parallel. In this example, the plurality of female members 120 have equal depths, are mutually equispaced and are mutually parallel. In this example, the waveguide comprises a first part (not shown) including one of a plurality of male members 110 and a second part (not shown) includes the remaining plurality of male members 110, wherein the first part is moveable, for example translatable, slideable, pivotable and/or rotatable, with respect to the second part. In this example, the first part includes half of the plurality of male members and the second part includes half the plurality of male members. In this example, the first part and the second part respectively include alternate male members 110 of the plurality of male members 110. In this example, a first half of the plurality of male members 110 (i.e. odd alternate male members) extend away from the first part and the second half of the plurality of male members 110 (i.e. even alternate male members) extend away from a second part, opposed to the first part. That is, the first half of the plurality of male members 110 extend towards the second half of the plurality of male members 110. In this example, a first half of the plurality of female members 120 (i.e. alternate female members), corresponding to the first half of the plurality of male members 110, are defined between adjacent males members 110 of the second half (i.e. by regions between the adjacent males members 110 of the second half). In this example, a second half of the plurality of female members 120 (i.e. alternate female members), corresponding to the second half of the male members 110, are defined between adjacent males members 110 of the first half (i.e. by regions between the adjacent males members 110 of the first half). That is, the first half of the plurality of male members 110 are received in the corresponding first half of the plurality of female members 120 defined by the opposed second half of the male members 110. In this example, the second half of the plurality of male members 110 are received in the corresponding second half of the plurality of female members 120 defined by the opposed first half of the plurality of male members. That is, the first half of the plurality of male members 110 intermesh or intersect with the second half of the plurality of male members 110. Hence, the waveguide 100 may be moved from the first configuration to the second configuration by moving the first part relative to the second part. In this way, all meander line lengths are changed simultaneously by a same amount.

In this example, the first effective delay line is based, at least in part, on a first meander line length and the second effective delay line is based, at least in part, on a second meander line length, wherein the first meander line length is different from the second meander line length. As shown in FIG. 1B, $\alpha'_{variable}$ meanders through one period of the waveguide 100 between the male members 110 and the female members 120, thus having a length of approximately twice a length of a male member 110 or depth of a female member 120. In this example, scanning a beam is provided by changing a meander line length by moving the plurality of male members 110 relative to the respective female members 120, for example simultaneously. Particularly, the male members 110 are moved together into or out of the corresponding female members 120. The waveguide 100 comprises sixteen (i.e. a plurality) radiating apertures 130 (130A-130P), specifically rectangular slots arranged at 45° to a longitudinal x axis of the waveguide 100.

Figure 2:
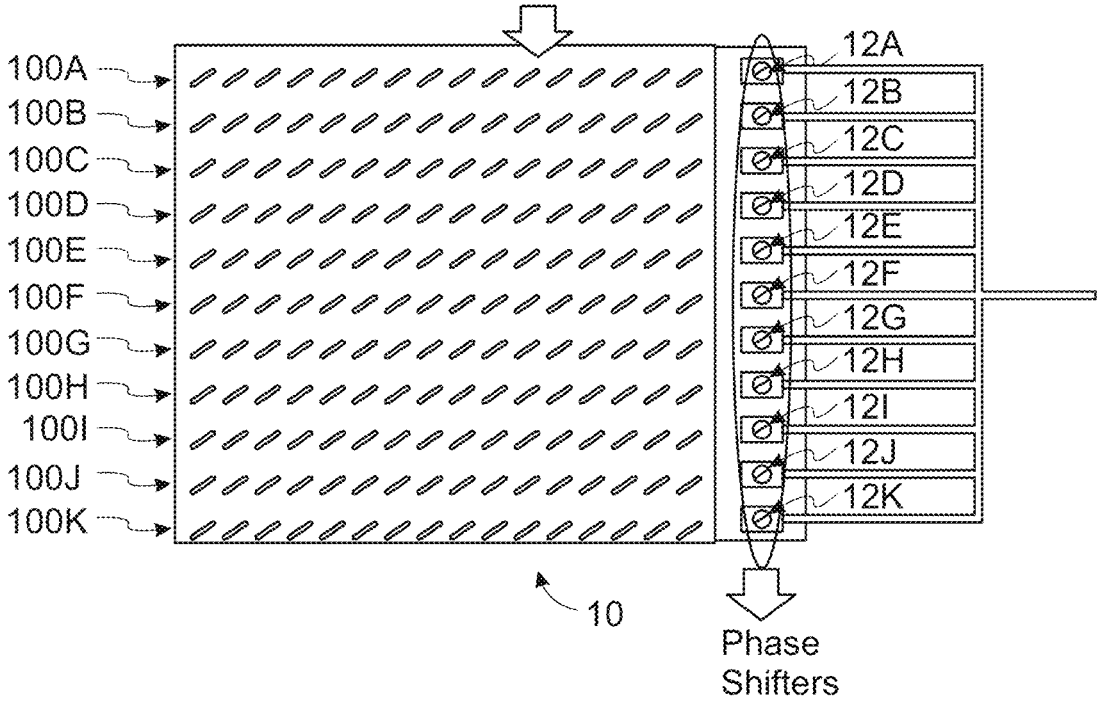
FIG. 2 schematically depicts an antenna according to an exemplary embodiment comprising the waveguide of FIGS. 1A to 1B.

FIG. 2 schematically depicts an antenna 10 according to an exemplary embodiment comprising the waveguide 100 of FIGS. 1A to 1B. Particularly, FIG. 2 shows a plan view of the antenna 10 comprising a plurality of the waveguides 100 (100A-100K).

The leaky wave antenna 10 comprises the first waveguide 100 and a first actuator (not shown) arranged to move the first waveguide 100 from the first configuration to the second configuration. The antenna 10 is arranged to scan a beam having a predetermined frequency in an elevation plane by actuating the first actuator, thereby moving the first waveguide 100 from the first configuration to the second configuration.

In more detail, the leaky wave antenna 10 is a 2D array of 1D transmission lines, provided by a plurality of waveguides 100A-100K. The leaky wave antenna 10 comprises eleven (i.e. a plurality) waveguides 100A-100K and eleven (i.e. a plurality) actuators 11A-11K (not shown) arranged to move respective waveguides 100A-100K from the first configuration to the second configuration. In this example, the leaky wave antenna 10 comprises eleven (i.e. a plurality) phase shifters 12A-12K for the respective eleven waveguides 100A-100K.

Figure 3A:
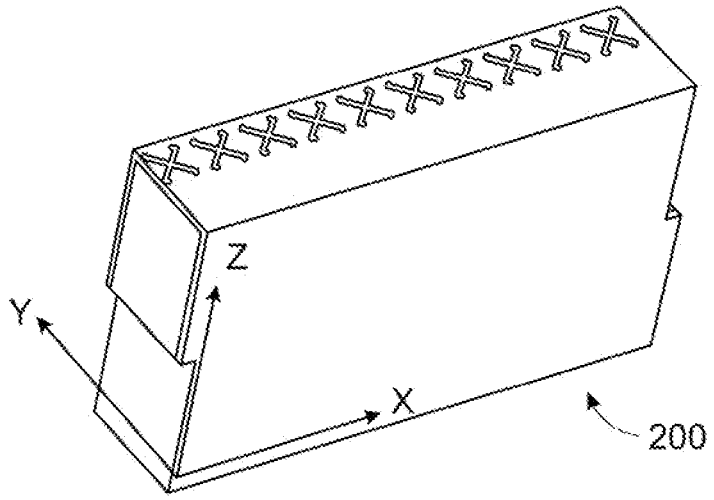
FIGS. 3A to 3D schematically depict a waveguide according to an exemplary embodiment.
Figure 3B:
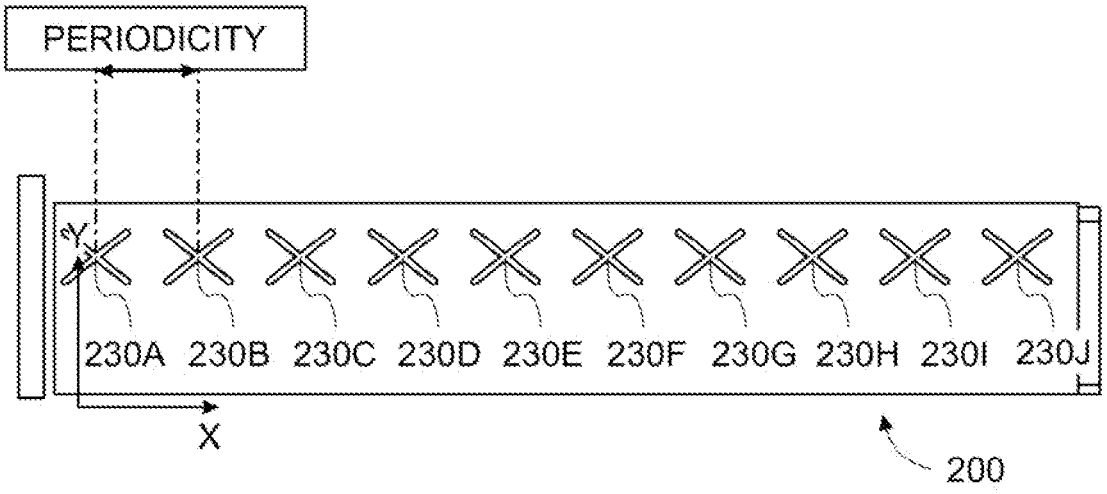
Figure 3C:
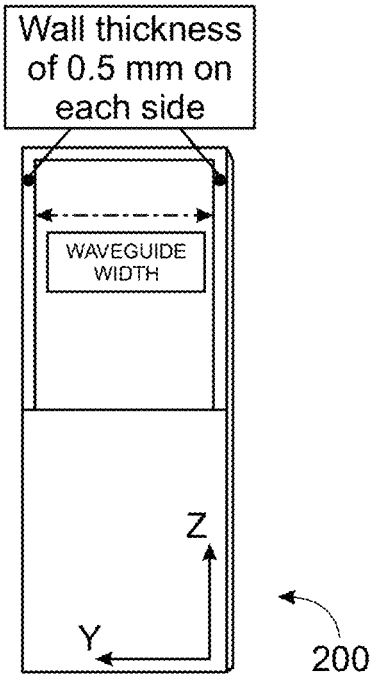
Figure 3D:
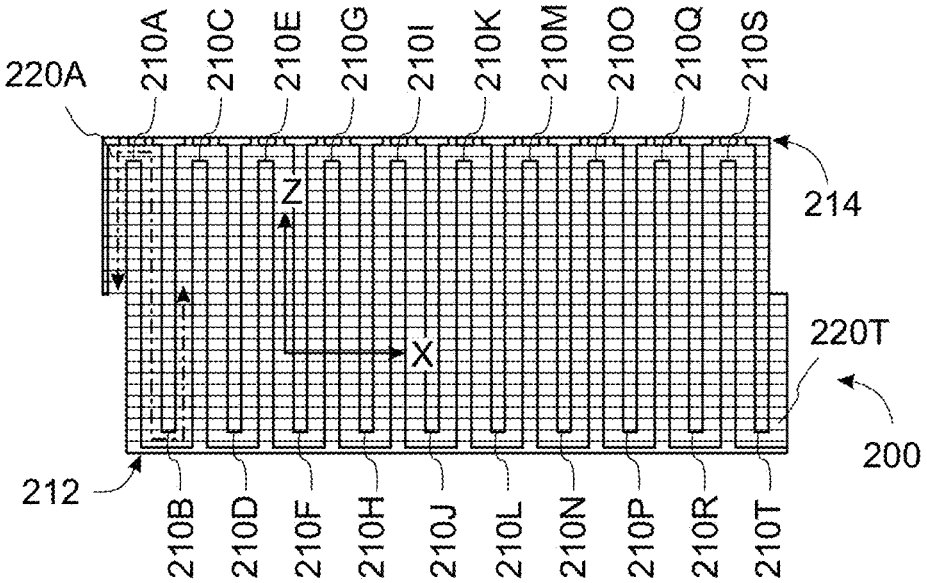

FIGS. 3A to 3D schematically depict a waveguide 200 according to an exemplary embodiment. Particularly, the waveguide 200 provides a 1D antenna for elevation scanning. Particularly, FIG. 3A shows a perspective view of the waveguide 200, FIG. 3B shows a plan view of the waveguide 200, FIG. 3C shows a cross sectional view in the x-z plane of the waveguide 200 and FIG. 3D shows a cross sectional view in the y-z plane of the waveguide 200.

The waveguide 200 is for a leaky wave antenna 20, as described below. The waveguide 200 comprises a male member 210 (210A-210T) and a corresponding female member 220 (220A-220T) arranged to receive the male member 210 (210A-210T) therein. The waveguide is arrangeable in a first configuration and a second configuration. The male member 210 (210A-210T) is received in the female member 220 (220A-220T) spaced apart therefrom in the first configuration and the second configuration. The first configuration defines a first effective delay line. The second configuration defines a second effective delay line. The first effective delay line is different from the second effective delay line.

In more detail, the waveguide 200 provides a 1D transmission line. The waveguide comprises twenty (i.e. a plurality) male members 210 (210A-210T) and twenty respective corresponding female members 220 (220A-220T) arranged to receive the respective male members 210 (210A-210T) therein. For clarity, reference signs are indicated for the female members 220A and 220T only; remaining female members 220B-220S may be similarly indicated therebetween.

In this example, the waveguide 200 is a meandered waveguide 200. In this example, the plurality of male members 210 have equal lengths, are mutually equispaced and are mutually parallel. In this example, the plurality of female members 220 have equal depths, are mutually equispaced and are mutually parallel. In this example, a first half of the plurality of male members 210 (210A, 210C, 210E, 210G, 210I, 210K, 210M, 2100, 210Q and 210S) (i.e. odd alternate male members) extend away from a first part 212 and a second half of the plurality of male members 210 (210B, 210D, 210F, 210H, 210J, 210L, 210N, 210P, 210R and 210T) (i.e. even alternate male members) extend away from a second part 214, opposed to the first part 212. That is, the first half of the plurality of male members 210 extend towards the second half of the plurality of male members 210. In this example, a first half of the plurality of female members 220 (220A, 220C, 220E, 220G, 220I, 220K, 220M, 2200, 220Q and 220S) (i.e. alternate female members), corresponding to the first half of the plurality of male members 210, are defined between adjacent males members 210 of the second half (i.e. by regions between the adjacent males members 210 of the second half). In this example, a second half of the plurality of female members 220 (220B, 220D, 220F, 220H, 220J, 220L, 220N, 220P, 220R and 220T) (i.e. alternate female members), corresponding to the second half of the male members 210, are defined between adjacent males members 210 of the first half (i.e. by regions between the adjacent males members 210 of the first half). That is, the first half of the plurality of male members 210 are received in the corresponding first half of the plurality of female members 220 defined by the opposed second half of the male members 210. In this example, the second half of the plurality of male members 210 are received in the corresponding second half of the plurality of female members 220 defined by the opposed first half of the plurality of male members. That is, the first half of the plurality of male members 210 (210A, 210C, 210E, 210G, 210I, 210K, 210M, 2100, 210Q and 210S) intermesh or intersect with the second half of the plurality of male members 210 (210B, 210D, 210F, 210H, 210J, 210L, 210N, 210P, 210R and 210T).

In this example, the first effective delay line is based, at least in part, on a first meander line length and the second effective delay line is based, at least in part, on a second meander line length, wherein the first meander line length is different from the second meander line length. As shown in FIG. 3D, a' variable (indicated by a dash dot line) meanders through one period of the waveguide 200 between the male members 210 and the female members 220, thus having a length of approximately twice a length of a male member 210 or depth of a female member 220. In this example, scanning a beam is provided by changing a meander line length by moving the plurality of male members 210 (210A-21 OT) relative to the respective female members 220 (220A-220T), for example simultaneously. Particularly, the male members 210A, 210C, 210E, 210G, 210I, 210K, 210M, 2100, 210Q and 21 OS are moved together into or out of the corresponding female members 220A, 220C, 220E, 220G, 2201, 220K, 220M, 2200, 220Q and 220S, thereby also moving the male members 210B, 210D, 210F, 210H, 210J, 21 OL, 210N, 21 OP, 21 OR and 210T are moved together into or out of the corresponding female members 220B, 220D, 220F, 220H, 220J, 220L, 220N, 220P, 220R and 220T. The waveguide 200 comprises ten (i.e. a plurality) radiating apertures 230 (230A-230J), specifically X shaped slots arranged on a longitudinal x axis of the waveguide 200. The waveguide 200 has an internal width (i.e. a width) of 2.4 mm.

Figure 4:
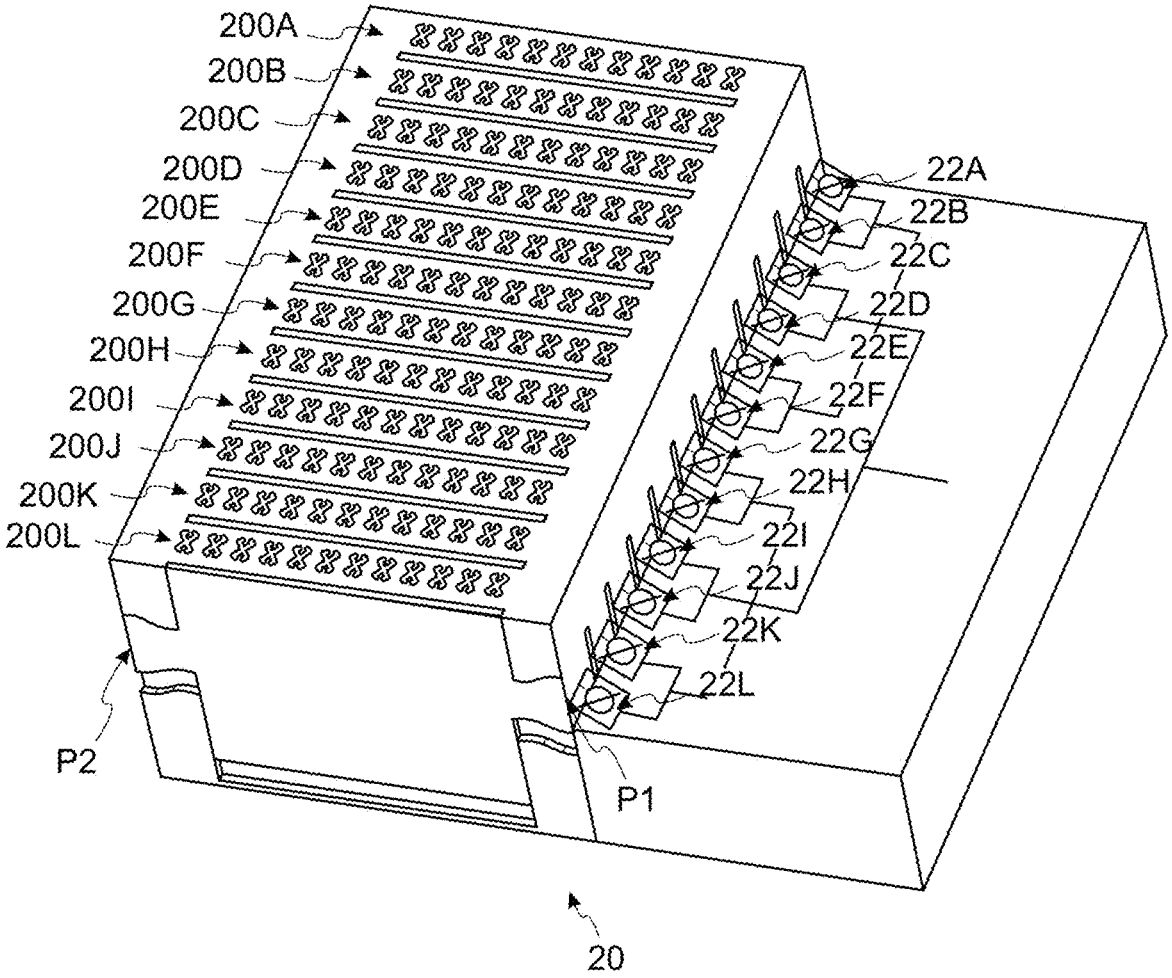
FIG. 4 schematically depicts an antenna according to an exemplary embodiment comprising the waveguide of FIGS. 3A to 3D.

FIG. 4 schematically depicts an antenna 20 according to an exemplary embodiment comprising the waveguide 200 of FIG. 2. Particularly, the antenna 20 is a 2D antenna for elevation and azimuth scanning.

The leaky wave antenna 20 comprises the first waveguide 200 and a first actuator 21 (not shown) arranged to move the first waveguide 200 from the first configuration to the second configuration. The antenna 20 is arranged to scan a beam having a predetermined frequency in an elevation plane by actuating the first actuator 21, thereby moving the first waveguide 200 from the first configuration to the second configuration.

In more detail, the leaky wave antenna 20 is a 2D array of 1 D transmission lines, provided by a plurality of waveguides 200 (200A-200L). The leaky wave antenna 20 comprises twelve (i.e. a plurality) waveguides 200A-200L and twelve (i.e. a plurality) actuators (not shown) arranged to move respective waveguides 200A-200L from the first configuration to the second configuration. In this example, the leaky wave antenna 20 comprises twelve (i.e. a plurality) phase shifters 22A-22L for the respective twelve waveguides 200A-200L. Each waveguide 200 comprises two ports P1, P2, arranged at opposed ends of the waveguide 200.

Figure 5:
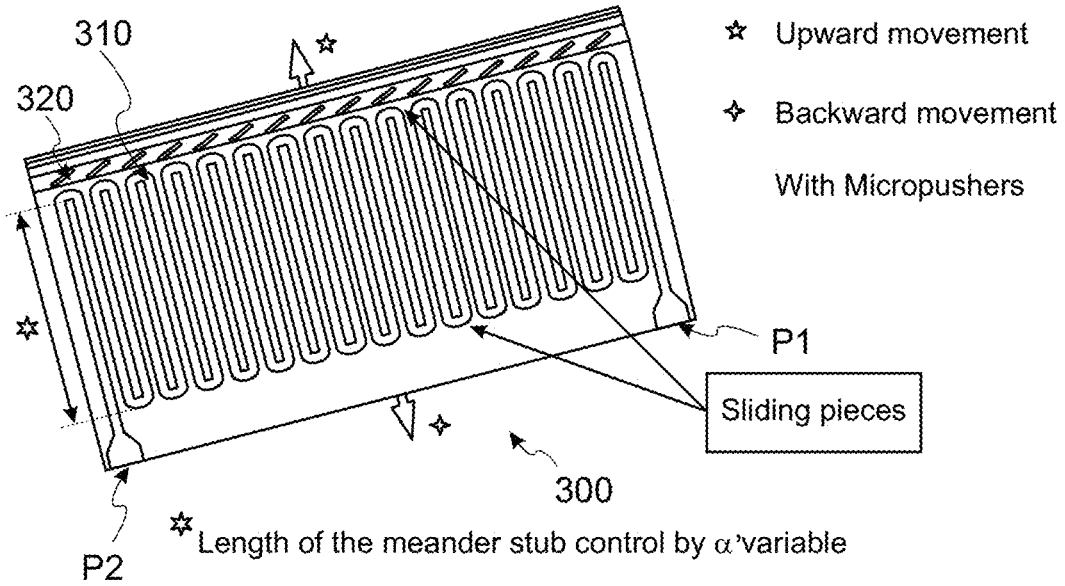
FIG. 5 schematically depicts a waveguide according to an exemplary embodiment.

FIG. 5 schematically depicts a waveguide 300 according to an exemplary embodiment. Particularly, FIG. 5 shows a perspective sectional view of the waveguide 300.

The waveguide 300 is for a leaky wave antenna. The waveguide 300 comprises a male member 310 and a corresponding female member 320 arranged to receive the male member 310 therein. The waveguide is arrangeable in a first configuration and a second configuration. The male member 310 is received in the female member 320 spaced apart therefrom in the first configuration and the second configuration. The first configuration defines a first effective delay line. The second configuration defines a second effective delay line. The first effective delay line is different from the second effective delay line.

In more detail, the waveguide 300 provides a 1D transmission line. The waveguide 300 is a meandered waveguide 300, as described above with respect to the meandered waveguide 200. The waveguide comprises twenty three (i.e. a plurality) male members 310 and twenty three respective corresponding female members 320 arranged to receive the respective male members 310 therein. In this example, the first effective delay line is based, at least in part, on a first meander line length and the second effective delay line is based, at least in part, on a second meander line length, wherein the first meander line length is different from the second meander line length. In other words, scanning a beam is provided by changing a meander line length by moving the plurality of male members 310 relative to the respective female members 320, for example simultaneously.

Particularly, FIG. 5 shows a sliding arrangement for the waveguide 300, specifically a slotted waveguide having a variable value of $\alpha'_{variable}$, thereby providing a 1D transmission line using a slotted waveguide, as described previously with respect to the waveguide 200.

In this example, the male member slides (i.e. moves, translates) relative to the female member, actuated by a micropusher. The amount of movement required is determined by the minimum and maximum value of $\alpha'_{variable}$, as described above.

The waveguide 300 comprises two ports P1, P2.

Figure 6:
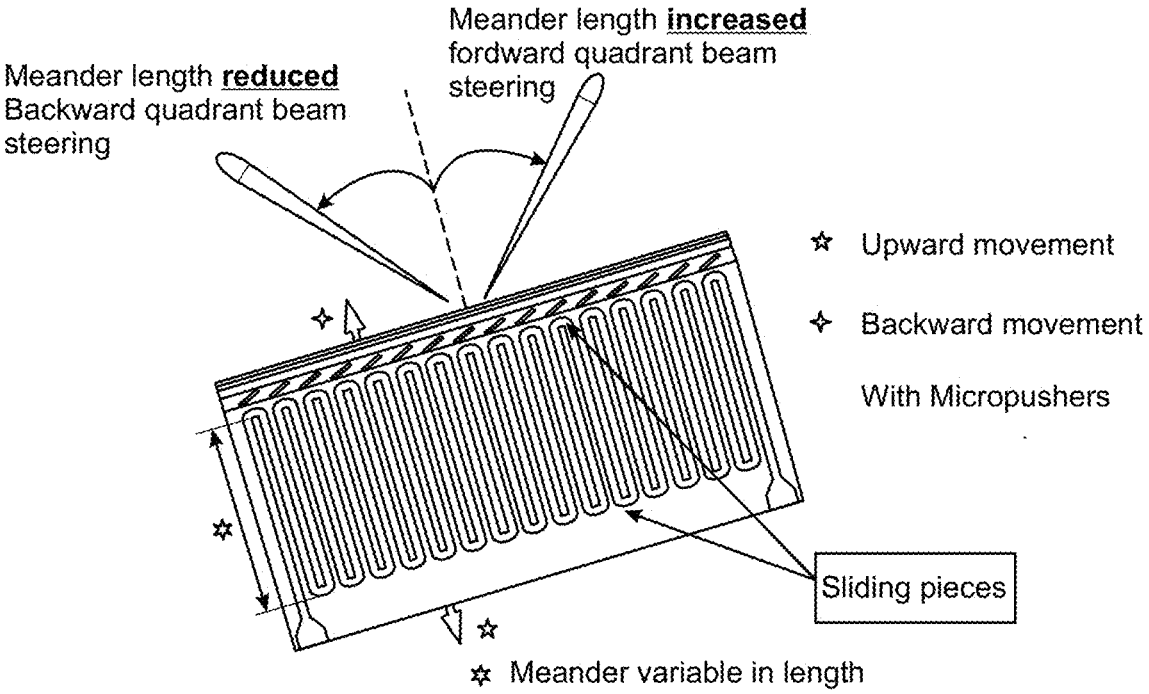
FIG. 6 schematically depicts the waveguide of FIG. 5, in use.

FIG. 6 schematically depicts the waveguide 300 of FIG. 5, in use. Particularly, FIG. 6 shows a perspective sectional view of the waveguide 300, in use.

By increasing the meander line length, for example from the first meander line length to the second meander line length, the beam is steered towards the forward quadrant in the elevation plane. Conversely, by decreasing the meander line length, for example from the second meander line length to the first meander line length, the beam is steered towards the backward quadrant in the elevation plane.

Figure 7A:
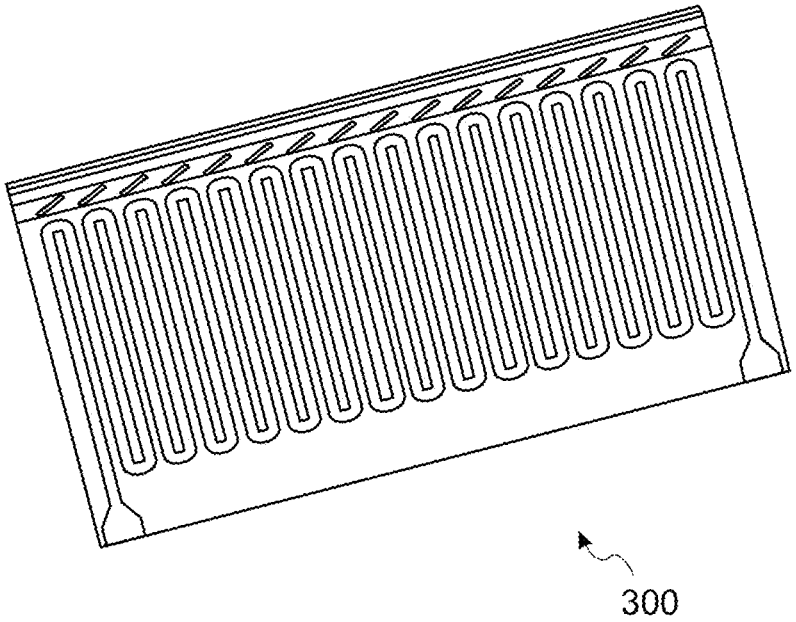
FIG. 7A to 7C schematically depict a simulated model of the waveguide of FIG. 5.
Figure 7B:
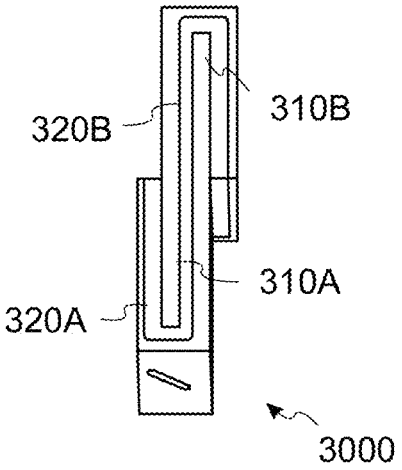
Figure 7C:
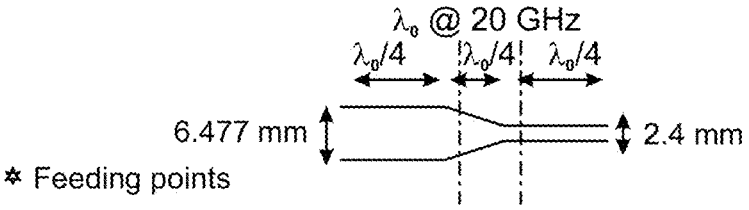

FIGS. 7A to 7C schematically depict a simulated model of the waveguide 300 of FIG. 5. Particularly, FIG. 7A shows a perspective sectional view of the simulated model of the waveguide 300, FIG. 7B shows a perspective view of a unit element 3000 of the waveguide 300 and FIG. 7C shows a taper made to match the waveguide cavity.

Particularly, FIG. 7A shows a section in the XZ plane of the waveguide 300 simulated with taper and chamfering of corners. FIG. 7B shows the unit element 3000 (comprising two male members 310A, 310B and two respective corresponding female members 320A, 320B and thus defining therein $\alpha'_{variable}$, as discussed previously) used for corner correction. FIG. 7C shows a taper made to match the waveguide cavity and is also the feeding point (one for each port) of the structure. The length of the unit element 3000 is initially estimated using an in-house MATLAB code. The final length for simulations with CST, has been corrected to consider internal radii of a manufactured waveguide 300. Hence, different $\alpha'_{variable}$ may be obtained for MATLAB and CST simulations or waveguides 300 manufactured according to the CST simulations.

In more detail, FIGS. 7A to 7C show the waveguide 300 as simulated in CST Microwave Studio with the chamfered corners and depicts the unit element 3000 used to make the waveguide 300. The simulated designs (one for backward scanning and one for forward scanning) each have 16 elements as shown in FIG. 7A. The operating frequency is 20 GHz and thus WR-51 flanges (12.954 mm×6.477 mm) are employed for the feeding and the measurements. Additionally, only the $TE_{10}$ mode is being considered for propagation and the waveguide shall be as compact as possible, therefore the waveguide's height is chosen to be 2.4 mm. This means that the waveguide cavity is 12.954 mm×2.4 mm. This implies that a taper design to match the waveguide cavity (12.954 mm×2.4 mm) to the standard WR-51 flange dimensions is required. In addition, this design has the taper integrated, which consists of 3 parts depicted in FIG. 7C. Taking into account that the spacing between two elements is 6.84 mm and that we have 16 elements, the total waveguide's length is 110 mm. The width of the waveguide is 12.954 mm and an additional 1 mm on each side for the wall thickness. The total waveguide's height is 50.6 mm taking into account the taper for the prototype scanning backward and at 57.1 mm for the prototype scanning forward.

Two designs, having different values of $\alpha'_{variable}$ as described below, were simulated using electromagnetic tool CST Microwave Studio® available from CST Computer Simulation Technology GmbH, Germany. Optimization was performed on the unit element 3000 for each design. Initially, optimization included a phase correction due to the corners of the meandered topology and slot geometry correction (length, width, and distance from centre of waveguide) in order to have resonant or close to resonant slots. The phase correction translates into adjusting the value of the meander length (i.e. $\alpha'_{variable}$). For the backward scanning, the theoretical value of the meander length was 85.5 mm (Table 1). After correction, that value increased to 87.6 mm. For the forward scanning, the theoretical value of the meander length was 98.5 mm (Table 1) and after correction, that value increased to 100.6 mm.

Figure 8:
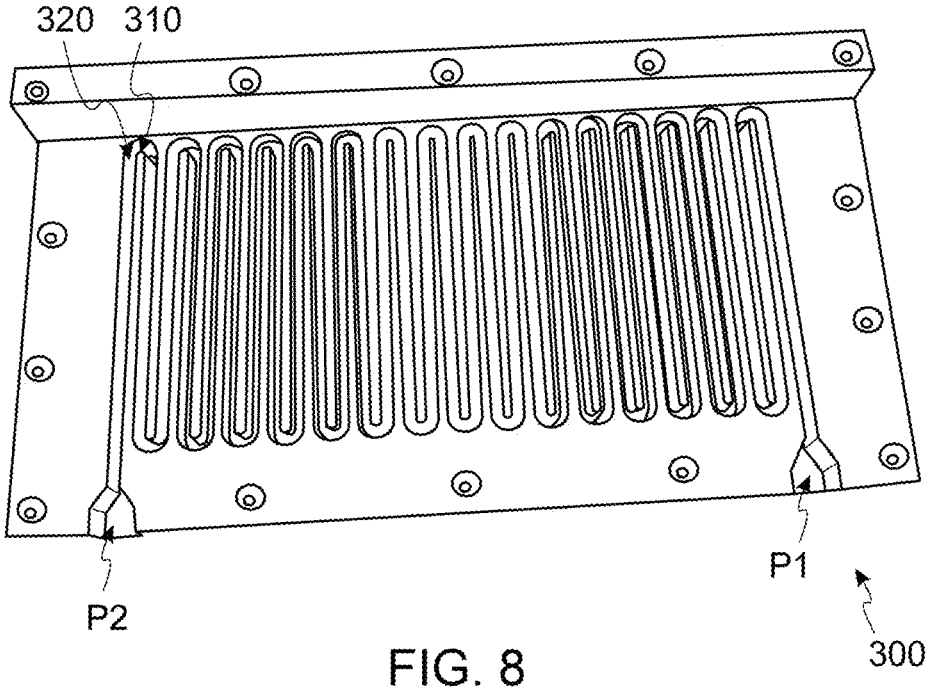
FIG. 8 schematically depicts a prototype of the waveguide of FIG. 5.

FIG. 8 schematically depicts a prototype of the waveguide 300 of FIG. 5. Two prototypes were manufactured, having fixed values of $\alpha'_{variable}$ of 85.5 (87.6) mm and 98.5 (100.6) mm, respectively. Using these two prototypes having different values of $\alpha'_{variable}$, behaviour of the simulated versus the manufactured waveguide 300 may be confirmed.

The waveguide 300 comprises two ports P1, P2.

Figure 9:
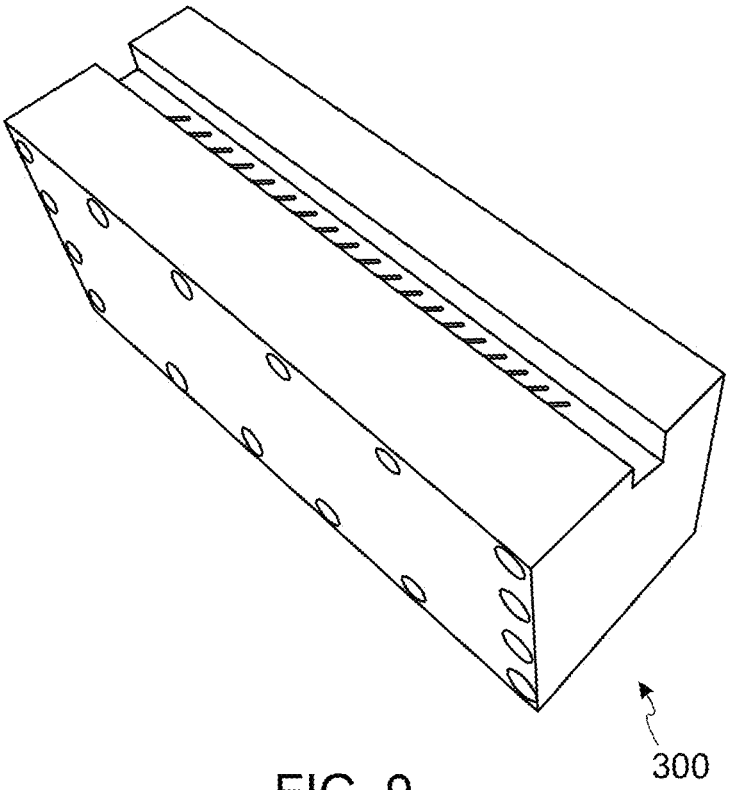
FIG. 9 schematically depicts a prototype antenna comprising the prototype waveguide of FIG. 8.

FIG. 9 schematically depicts a prototype antenna 30 comprising the prototype waveguide 300 of FIG. 8.

Table 1 includes the initially estimated values obtained from the MATLAB simulations of the waveguide 300. Referring to Table 1, the meander stub $\alpha'_{variable}$ (i.e. meander line length) should vary between 85.5 mm and 98.5 mm. In other words, the length of the meander stub, which is controlled by $\alpha'_{variable}$, will change according to which sliding piece moves. The underlined numbers in Table I indicate the values for the meander (and the corresponding scanning range) selected for the prototypes. These prototypes, when simulated and later on measured, are fed with a signal of varying frequency around 20 GHz (in this case 20±0.2 GHz). They produce a pencil beam that, at 20 GHz, theoretically points at −50.47° when the meander has a length of 85.5 mm and at +50.95° when the meander has a length of 98.5 mm.

TABLE 1

Theoretical scanning range and corresponding meander values at 20 GHz

| Scanning range (degrees) | Corresponding $\alpha'_{variable}$ meander value (mm) |
|---|---|
| −50.47° | 85.5 |
| −33.28° | 87.4 |
| −17.23° | 89.5 |
| −1.764° | 91.7 |
| +11.99° | 93.7 |
| +26.31° | 95.7 |
| +50.95° | 98.5 |

Table 2 summarizes the theoretical scanning range for the two simulated prototypes using MATLAB. At 20 GHz we obtain the same theoretical values underlined in Table 1. The theoretical beam squint associated with the prototype doing the backward scanning in the whole frequency range (19.8 GHz to 20.2 GHz) is of 31.51° and for the prototype doing the forward scanning it is of 33.2°.

TABLE 2

Theoretical scanning range and corresponding meander values

| Frequency (GHz) | Scanning range for meander stub at 85.5 mm (degrees) | Scanning range for meander stub at 98.5 mm (degrees) |
|---|---|---|
| 19.8 | −69.37° | 37.2° |
| 19.857 | −62.5° | 40.63° |
| 19.914 | −57.34° | 44.65° |
| 19.971 | −52.76° | 48.66° |
| 20 | −50.47° | 50.95° |
| 20.086 | −44.74° | 57.82° |
| 20.143 | −41.3° | 63.55° |
| 20.2 | −37.86° | 70.4° |

Figure 10:
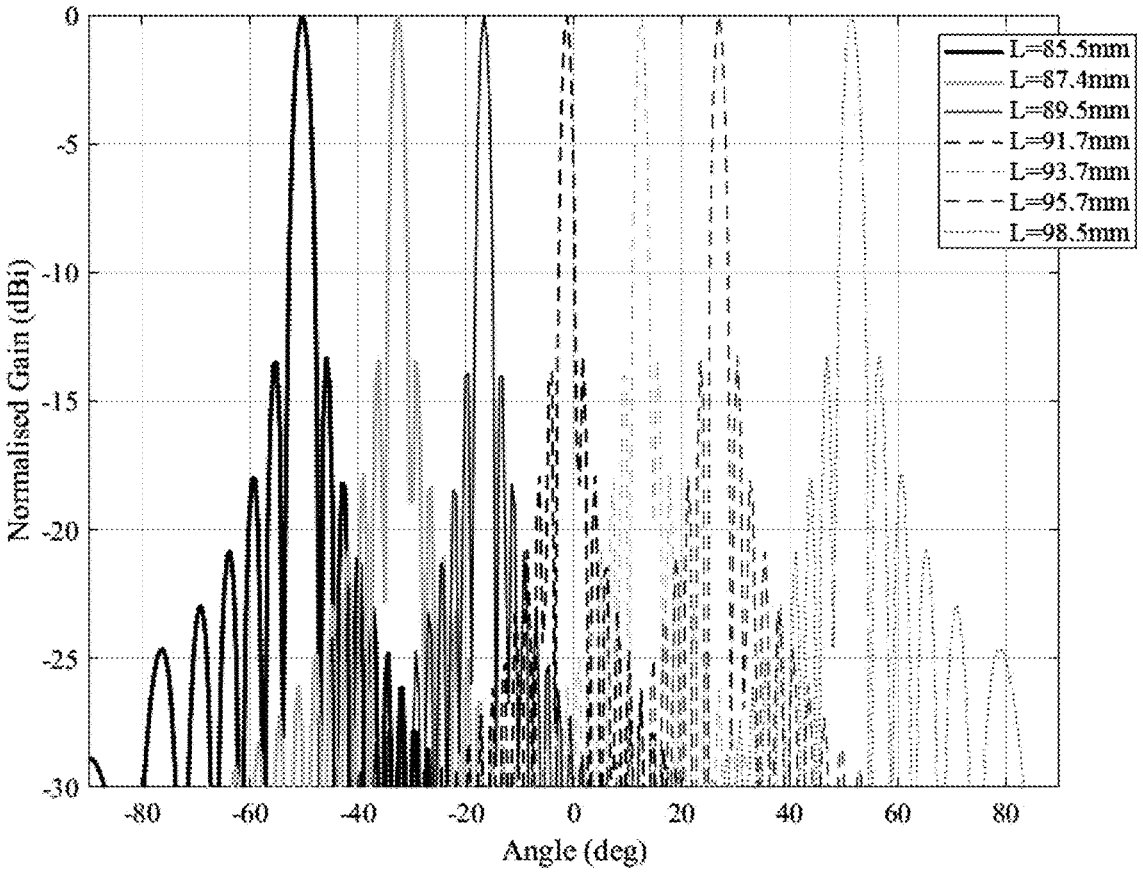
FIG. 10 schematically depicts calculated array factors for a simulated model of the waveguide of FIG. 5.

FIG. 10 schematically depicts calculated array factors for a simulated model of the waveguide of FIG. 5.

Particularly, FIG. 10 shows array factors showing the theoretical scanning range obtained using MATLAB with an initially estimated variable meander length for the required scanning range.

The theoretical design, as described above, was applied with a fixed operational frequency (20 GHz) and a variable meander length permit scanning from −50.47° (far left black in the FIG. 7 L=85.5 mm) to +50.95° (far right dotted grey line in the FIG. 7 L=98.5 mm). The first angle corresponds to a meander length $\alpha'_{variable}$ of 85.5 mm and the second angle to a value of 98.5 mm for $\alpha'_{variable}$. The periodicity of the elements (i.e. the separation distance between two consecutive elements) is 6.84 mm. The obtained scanning range is shown in FIG. 10.

Table 1 (above) summarises the detailed scanning range and the corresponding values of the meander length for FIG. 10.

Figure 11A:
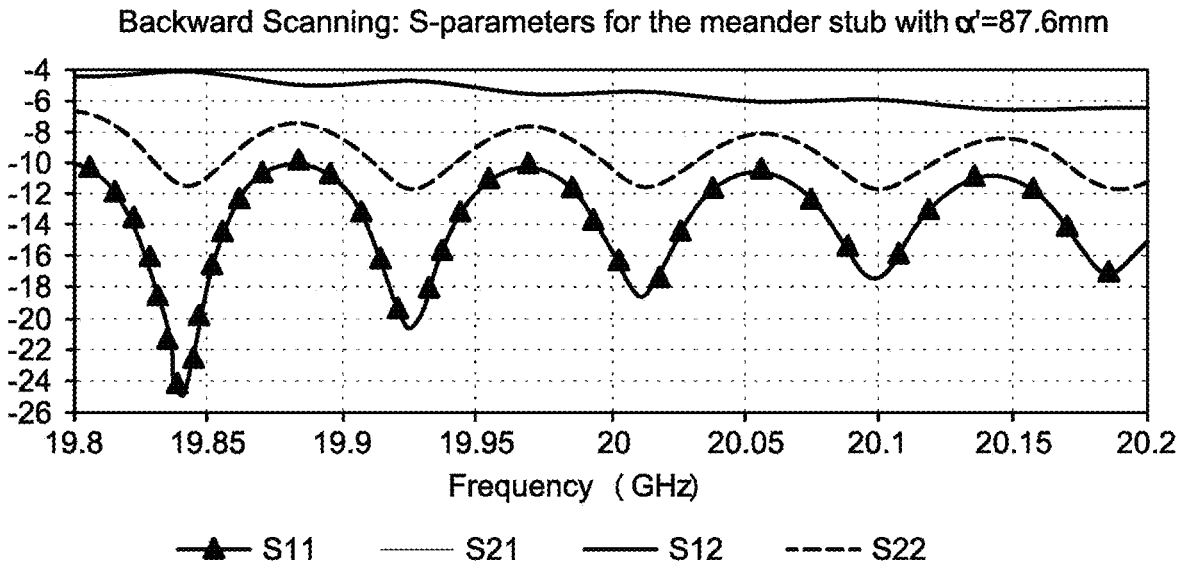
FIGS. 11A to 11B schematically depict simulated S-parameters of the prototype antenna of FIG. 9.
Figure 11B:
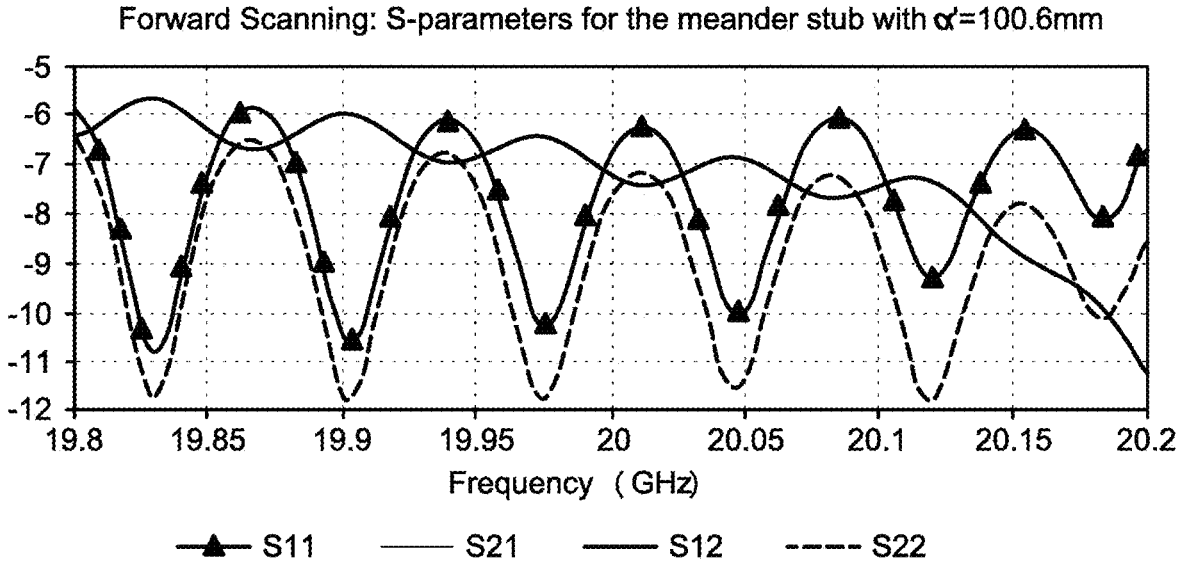

FIGS. 11A to 11B schematically depict simulated S-parameters of the prototype antenna of FIG. 9;

Particularly, FIGS. 11A to 11B show S-parameters for backward and forward scanning, respectively, from CST simulations. Matrix elements S11, S12, S21, S22 are referred to as the scattering parameters or the S-parameters. The elements S11 and S22 are reflection coefficients, and the elements S21 and S12 are transmission coefficients.

Figure 12A:
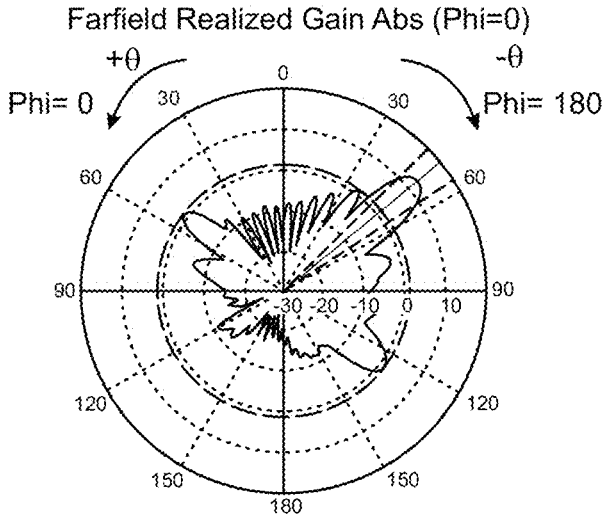
FIGS. 12A to 12B schematically depict measured radiation patterns of the prototype antenna of FIG. 9.
Figure 12B:
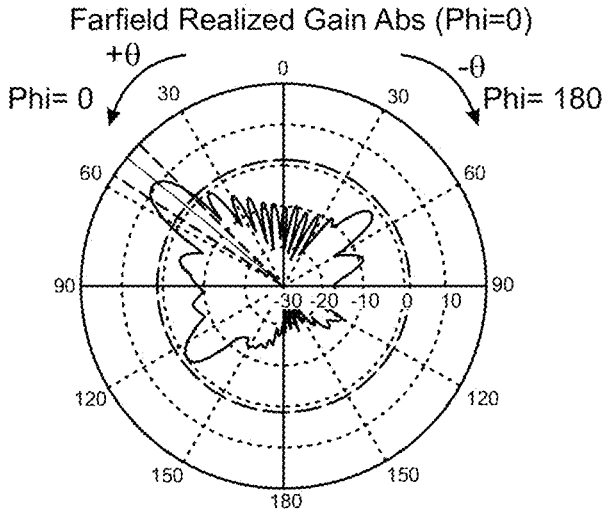

FIGS. 12A to 12B schematically depict measured radiation patterns of the prototype antenna 30 of FIG. 9.

Particularly, FIG. 12A to 12B show radiation patterns for the backward (FIG. 12A) and forward (FIG. 12B) prototypes at 20 GHz. The directivities are respectively 14.6 dBi and 16.3 dBi.

Table 3 shows the scanning angles obtained as well as the realized gain for the two simulated prototypes for the backward and forward scanning in elevation using CST.

TABLE 3

Scanning angles and realized gain for the prototypes for backward and forward scanning respectively.

| Frequency (GHz) | Scanning range for meander stub at 87.6 mm from CST (degrees) | Realized Gain for meander stub at 87.6 mm from CST (dBi) | Scanning range for meander stub at 100.6 mm from CST (degrees) | Realized Gain for meander stub at 100.6 mm from CST (dBi) |
|---|---|---|---|---|
| 19.8 | −68° | 9.77 | 36° | 12.8 |
| 19.857 | −63° | 10.3 | 39° | 13 |
| 19.914 | −57° | 11.3 | 43° | 13.6 |
| 19.971 | −52° | 11.8 | 48° | 13.8 |
| 20 | −50° | 12.4 | 50° | 13.4 |
| 20.086 | −45° | 13 | 57° | 12.8 |
| 20.143 | −41° | 13.1 | 64° | 12.9 |
| 20.2 | −38° | 13.7 | 70° | 13.4 |

Table 4 shows the S12 parameters for both prototypes at 19.8, 20 and 20.2 GHz and FIGS. 11A to 11B show the S-parameters throughout the 19.8 to 20.2 GHz range. FIGS. 11A to 11B show the radiation patterns for each prototype at the operating frequency of 20 GHz, as discussed below. The radiation efficiency (Eff.) of an antenna is defined as the ratio of the realized gain over directivity. Taking that into account, the radiation efficiencies for the backward scanning and the forward scanning antennas at 20 GHz are respectively: 59.6% and 51.6% knowing that at 20 GHz the directivities are of 14.6 dBi for the backward scanning antenna and of 16.3 dBi for the forward scanning antenna.

TABLE 4

S12 parameter for the two simulated prototypes

| Frequency (GHz) | S12 for the meander stub at 87.6 mm from CST (dB) | S12 for the meander stub at 100.6 mm from CST (dB) |
|---|---|---|
| 19.8 | −4.41 | −6.41 |
| 20 | −5.41 | −7.41 |
| 20.2 | −6.47 | −11.3 |

Figure 13:
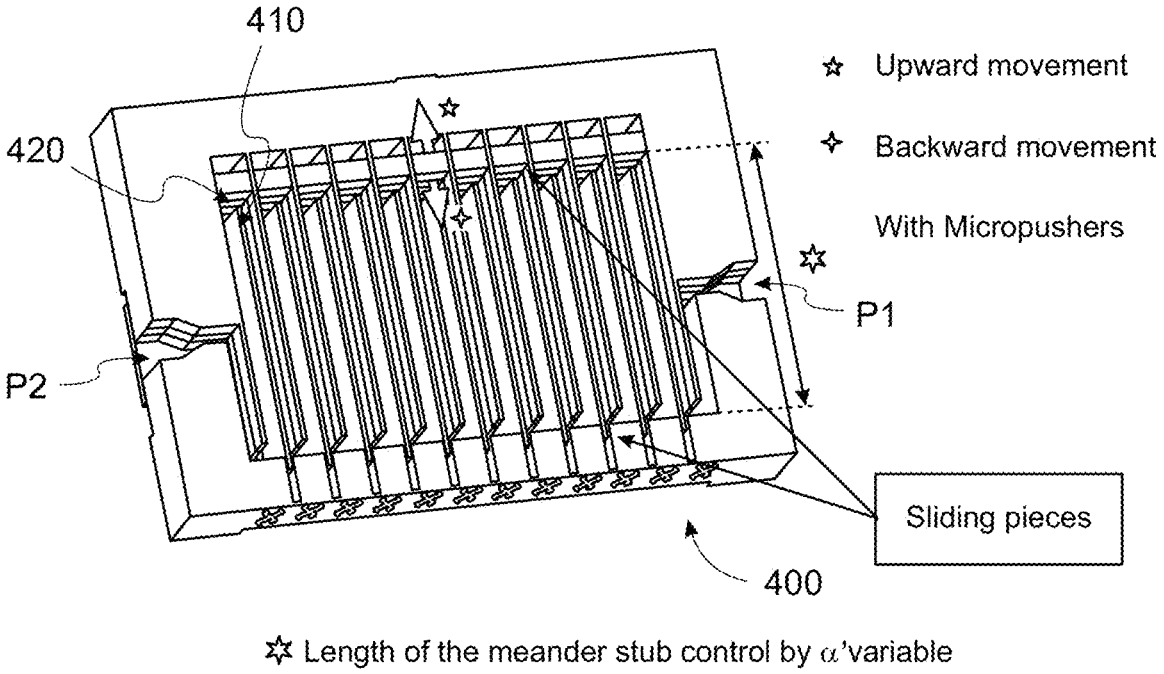
FIG. 13 schematically depicts a waveguide according to an exemplary embodiment.

FIG. 13 schematically depicts a waveguide 400 according to an exemplary embodiment. Particularly, FIG. 14 shows a perspective view of the waveguide 400.

Figure 14A:
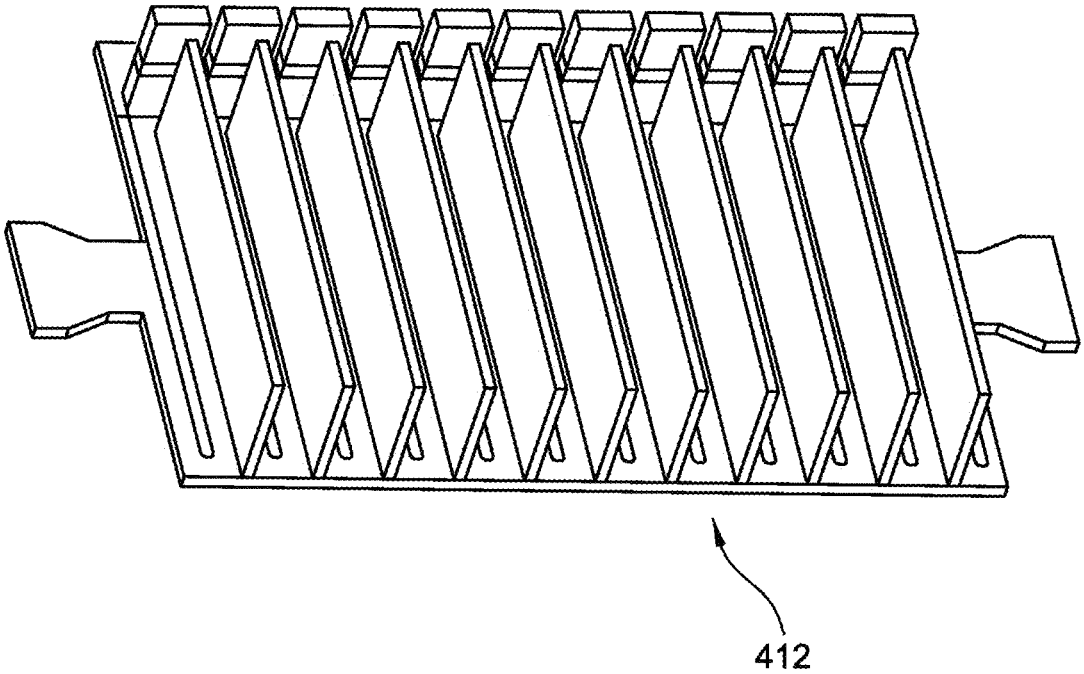
FIGS. 14A to 14B schematically depict the waveguide of FIG. 13, in more detail.
Figure 14B:
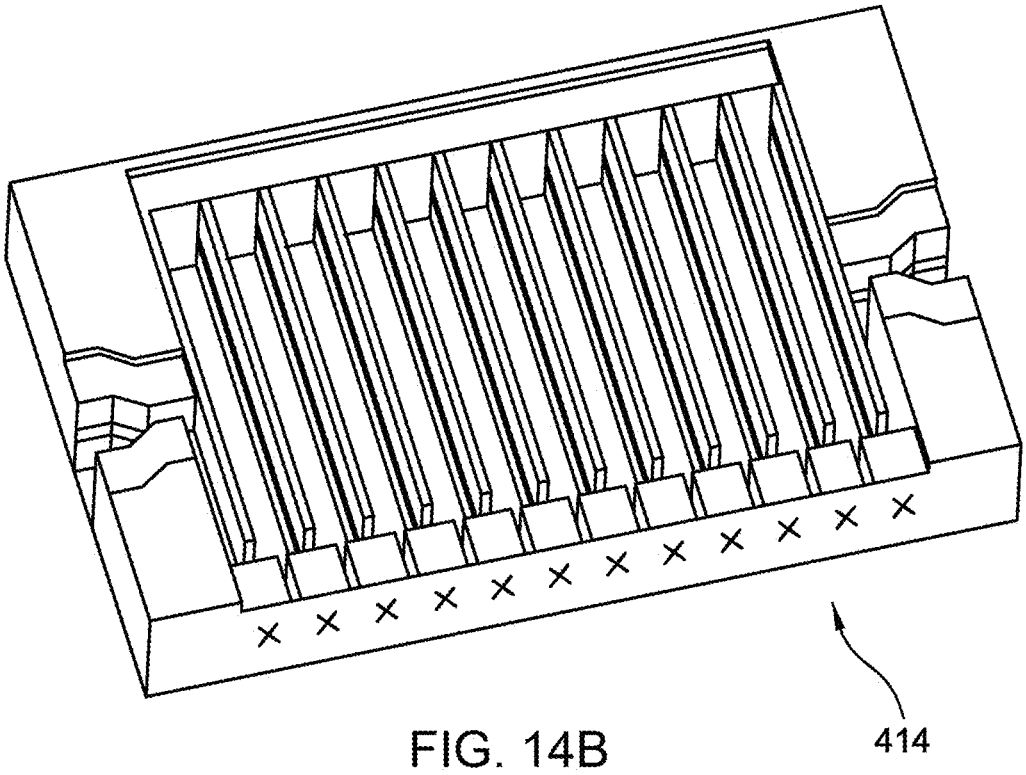

FIGS. 14A to 14B schematically depict the waveguide 400 of FIG. 13, in more detail. Particularly, FIG. 14A shows a perspective view of a first part 412 of the waveguide 400 and FIG. 14A shows a perspective view of a second part 414 of the waveguide 400.

The waveguide 400 is based on the waveguide 300, as described above, and thus common features may not be described, for brevity.

The waveguide 400 is for a leaky wave antenna. The waveguide 400 comprises a male member 410 and a corresponding female member 420 arranged to receive the male member 410 therein. The waveguide is arrangeable in a first configuration and a second configuration. The male member 410 is received in the female member 420 spaced apart therefrom in the first configuration and the second configuration. The first configuration defines a first effective delay line. The second configuration defines a second effective delay line. The first effective delay line is different from the second effective delay line.

In more detail, the waveguide 400 provides a 1D transmission line. The waveguide 400 is a meandered waveguide 400, as described above with respect to the meandered waveguide 200. The waveguide comprises twenty three (i.e. a plurality) male members 410 and twenty three respective corresponding female members 420 arranged to receive the respective male members 410 therein. In this example, the first effective delay line is based, at least in part, on a first meander line length and the second effective delay line is based, at least in part, on a second meander line length, wherein the first meander line length is different from the second meander line length. In other words, scanning a beam is provided by changing a meander line length by moving the plurality of male members 410 relative to the respective female members 420, for example simultaneously.

In this example, the plurality of male members 410 have equal lengths, are mutually equispaced and are mutually parallel. In this example, the plurality of female members 420 have equal depths, are mutually equispaced and are mutually parallel. In this example, the waveguide comprises a first part 412 including one of a plurality of male members 410 and a second part 414 includes the remaining plurality of male members 410, wherein the first part 412 is moveable, for example translatable, slideable, pivotable and/or rotatable, with respect to the second part 414. In this example, the first part 412 includes half of the plurality of male members and the second part 414 includes half the plurality of male members 414. In this example, the first part 412 and the second part 414 respectively include alternate male members 410 of the plurality of male members 410. In this example, a first half of the plurality of male members 410 (i.e. odd alternate male members) extend away from the first part 412 and the second half of the plurality of male members 410 (i.e. even alternate male members) extend away from a second part 414, opposed to the first part 412. That is, the first half of the plurality of male members 410 extend towards the second half of the plurality of male members 410. In this example, a first half of the plurality of female members 420 (i.e. alternate female members), corresponding to the first half of the plurality of male members 410, are defined between adjacent males members 410 of the second half (i.e. by regions between the adjacent males members 410 of the second half). In this example, a second half of the plurality of female members 420 (i.e. alternate female members), corresponding to the second half of the male members 410, are defined between adjacent males members 410 of the first half (i.e. by regions between the adjacent males members 410 of the first half). That is, the first half of the plurality of male members 410 are received in the corresponding first half of the plurality of female members 420 defined by the opposed second half of the male members 410. In this example, the second half of the plurality of male members 410 are received in the corresponding second half of the plurality of female members 420 defined by the opposed first half of the plurality of male members. That is, the first half of the plurality of male members 410 intermesh or intersect with the second half of the plurality of male members 410. Hence, the waveguide 400 may be moved from the first configuration to the second configuration by moving the first part 412 relative to the second part 414. In this way, all meander line lengths are changed simultaneously by a same amount.

The waveguide 400 comprises two ports P1, P2, arranged at opposed ends of the waveguide 400.

Figure 15:
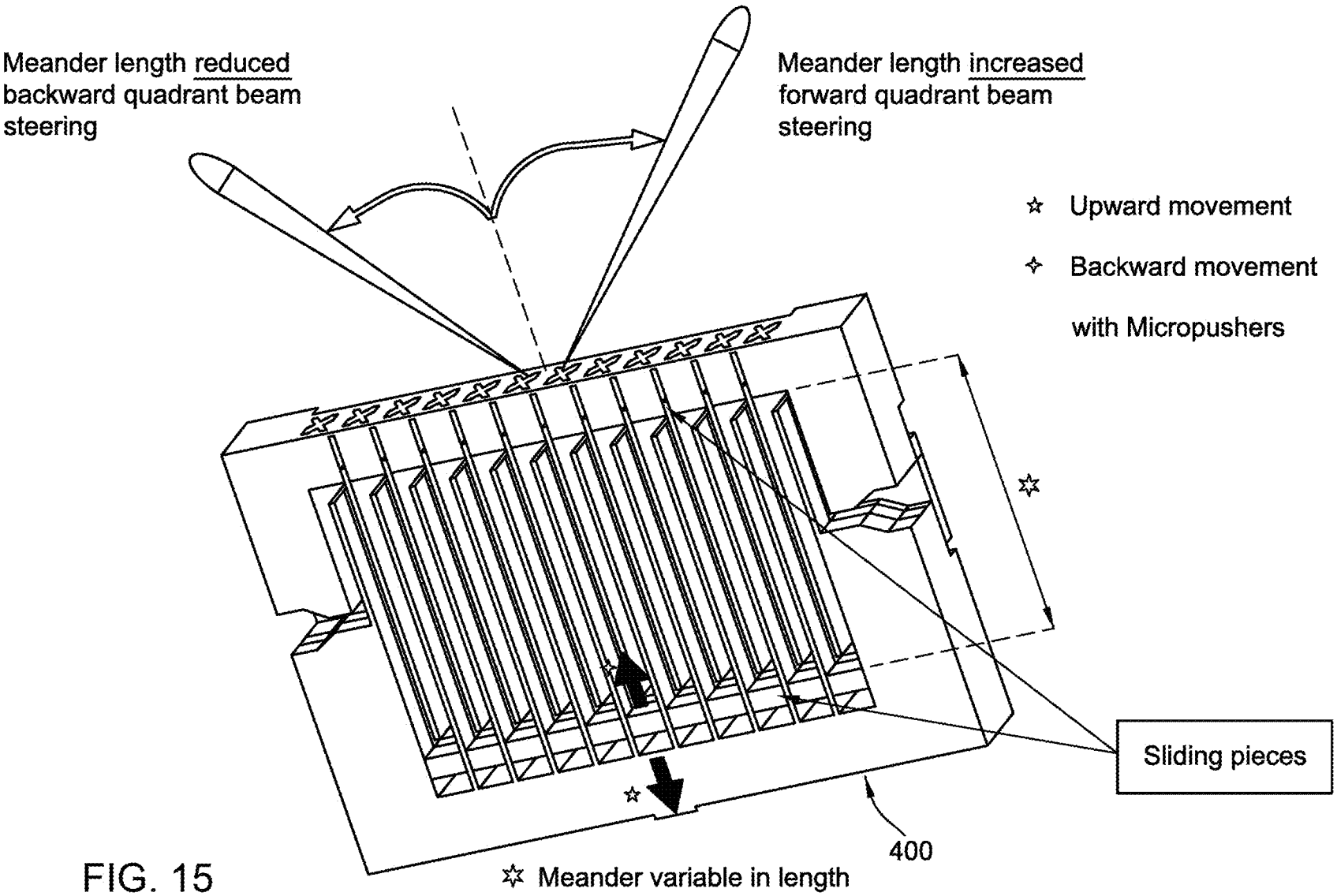
FIG. 15 schematically depicts the waveguide of FIG. 13, in use.

FIG. 15 schematically depicts the waveguide 400 of FIG. 13, in use. Particularly, FIG. 15 shows a perspective sectional view of the waveguide 400, in use.

By increasing the meander line length, for example from the first meander line length to the second meander line length, the beam is steered towards the forward quadrant in the elevation plane. Conversely, by decreasing the meander line length, for example from the second meander line length to the first meander line length, the beam is steered towards the backward quadrant in the elevation plane.

In this example, the first part slides (i.e. moves, translates) relative to the second part, actuated by a micropusher. The amount of movement required is determined by the minimum and maximum value of $\alpha'_{variable}$ as described above. The movement results in an increase of the meander length line.

Figure 16:
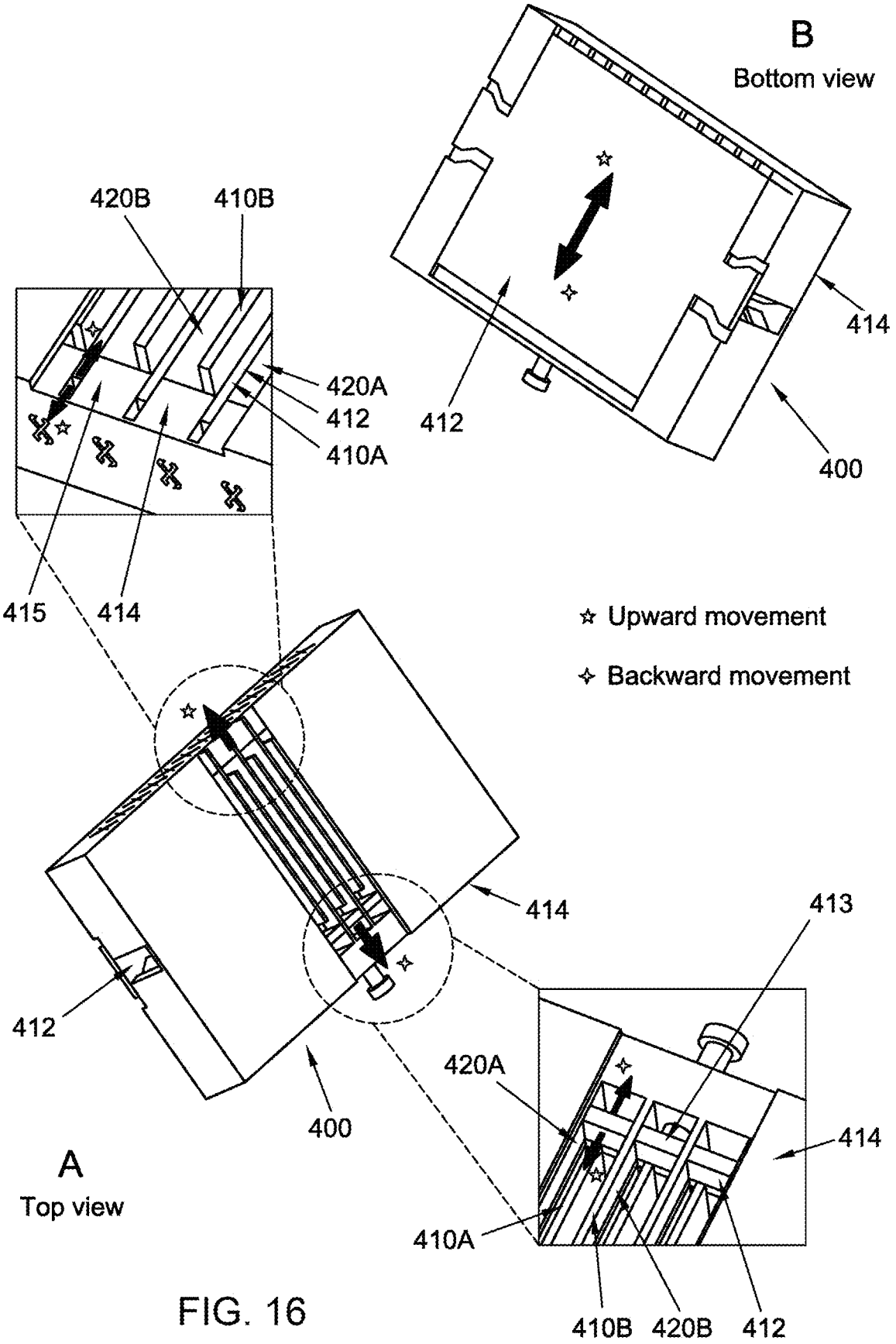
FIG. 16 schematically depicts the waveguide of FIG. 13, in use, in more detail.

FIG. 16 schematically depicts the waveguide 400 of FIG. 13, in use, in more detail. Particularly, FIG. 16A shows a perspective top view of the waveguide 400 and FIG. 16B shows a perspective bottom view of the waveguide 400. Also shown are two enlarged regions of FIG. 16A, showing these regions of the waveguide 400 in more detail. A cutaway is included in the perspective top view of the waveguide 400 so that some of the male members 410 and female members 420 are visible. As described above, in this example, the waveguide 400 comprises the first part 412 including half of the plurality of male members 410 and the second part 414 includes the remaining plurality of male members 410, wherein the first part 412 is moveable, for example translatable, slideable, pivotable and/or rotatable, with respect to the second part 414. In this example, the first part 412 and the second part 414 respectively include alternate male members 410 of the plurality of male members 410.

The waveguide 400 comprises the two parts 412, 414 brought together (i.e. assembled) as shown and as described herein. The first part 412 is inserted in to the second part 414 such that the respective male members 410 interleave.

Once inserted, when the first part 412 moves upwards, operated or actuated by using, for example a motor or a micropusher, the male member 410A will enter the gap 420A i.e. be received by the female member 420A. At the same time, a back wall 415 of the second part 414, will move upwards. The total effective length of the male member 410A, in the first part 412 will be reduced since part of the male member 410A will be inside the female member 420A. The effective length of the adjacent male member 420B, in the second part 414, will also and simultaneously be reduced by the same amount since a portion of the male member 420B will be behind a back wall 413 of the first part 412. As a result, the effective length of the meander line will reduce inside the structure.

Likewise, when the first part 412 moves downwards, the male member 410A, for instance, will come out the female member 420A. At the same time, the back wall 415 of the second part 414 will move downwards. The total effective length of the male member 410A, in the first part 412, will be increased since the portion of the male member 410A will come out from the female member 420A. The effective length of the male member 410B, in the second part, will increase since the portion of the male member 420B will come out from the back wall 413 of the first part 412. As a result, the effective length of the meander line will increase inside the structure.

Figure 17A:
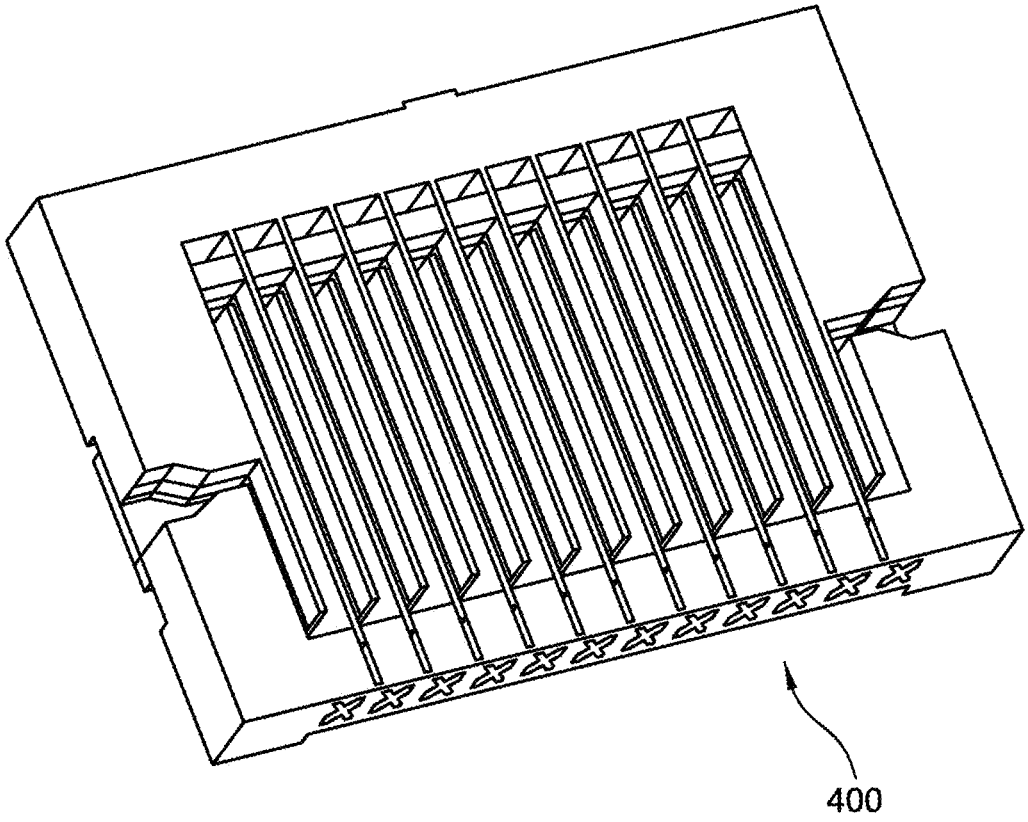
FIG. 17A to 17B schematically depict a simulated model of the waveguide of FIG. 13.
Figure 17B:
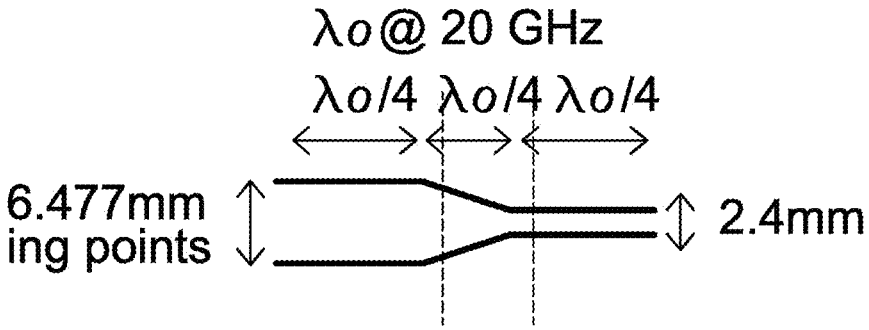

FIG. 17A to 17B schematically depict a simulated model of the waveguide 400 of FIG. 13. Particularly, FIGS. 17A to 17B show the CST simulated model of the waveguide 400 of FIG. 13.

Figure 18A:
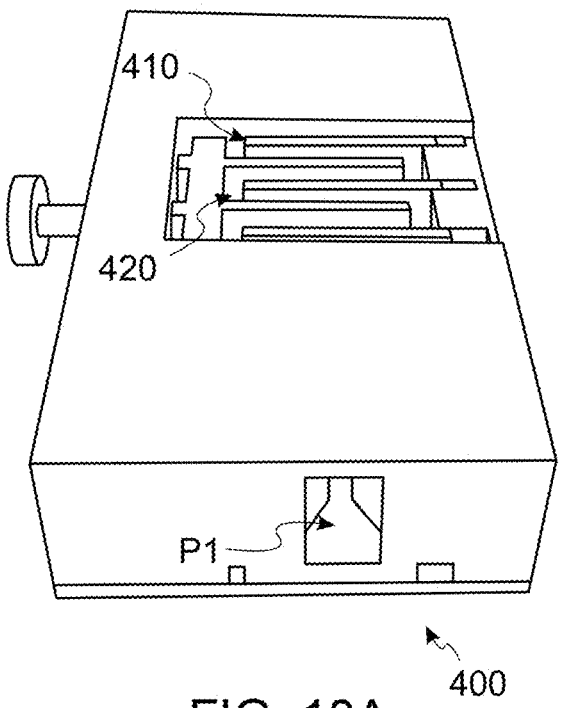
FIG. 18A to 18B schematically depict a model of the waveguide of FIG. 13.
Figure 18B:
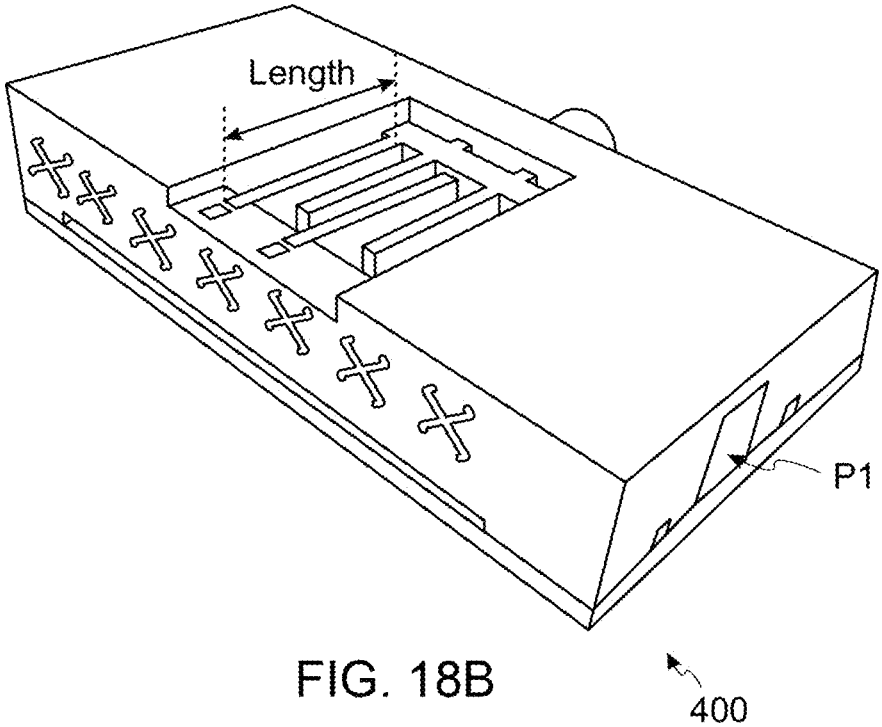

FIG. 18A to 18B schematically depict a model of the waveguide 400 of FIG. 13. Particularly, FIGS. 18A and 18B are photographs showing perspective views of the 3D printed model of the waveguide 400.

A cut out in a cover shows some of the male members 410 received in the female members 420. The waveguide 400 comprises two ports P1, P2.

Figure 19:
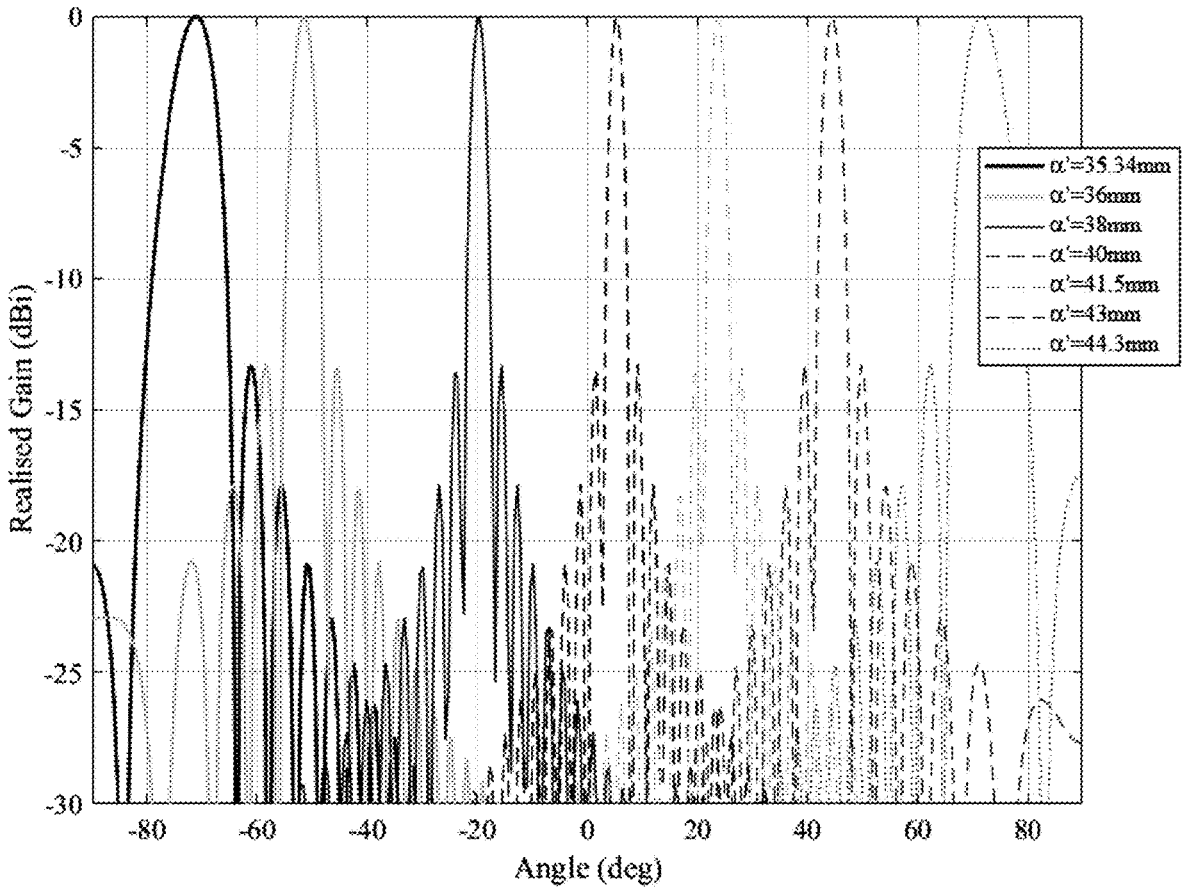
FIG. 19 schematically depicts calculated array factors for a simulated model of the waveguide of FIG. 13.

FIG. 19 schematically depicts calculated array factors for a MATLAB simulated model of the waveguide 400 of FIG. 13. Particularly, the calculated array factors are for a predetermined frequency of 31 Ghz, a periodicity of 3.5 mm and a variable $\alpha'_{variable}$.

Table 1 includes theoretical scanning ranges and corresponding meander values at 31 GHz for the waveguide 400.

TABLE 4

Theoretical scanning range and corresponding meander values at 31 GHz

| Corresponding $\alpha'_{variable}$ meander value (mm) | Scanning range |
|---|---|
| 35.34 | −71.09 |
| 36 | −51.61 |
| 38 | −19.53 |
| 40 | +5.1 |
| 41.5 | +24.02 |
| 43 | +44.65 |
| 44.3 | +71.57 |

Table 5 summarizes the theoretical scanning range for two prototypes with $\alpha'$=35.34 mm and $\alpha'$=44.3 mm for backward to forward scanning respectively. At 31 GHz we obtain the same theoretical values underlined in Table 4. The theoretical beam squint associated with the prototype doing the backward scanning in the whole frequency range (30.8 GHz to 31.2 GHz) is of 26.36° and for the prototype doing the forward scanning it is of 22°.

TABLE 5 theoretical scanning range for these two prototypes.

| Frequency (GHz) | Scanning range for meander stub at 35.34 mm (degrees) | Scanning range for meander stub at 44.3 mm (degrees) |
|---|---|---|
| 30.8 | −78.54° | 55° |
| 30.857 | −72.24° | 58° |
| 30.814 | −67.65° | 62° |

TABLE 5-continued theoretical scanning range for these two prototypes.

| Frequency (GHz) | Scanning range for meander stub at 35.34 mm (degrees) | Scanning range for meander stub at 44.3 mm (degrees) |
|---|---|---|
| 30.871 | −64.22° | 66.4° |
| 31 | −60.78° | 71° |
| 31.086 | −57.91° | 77° |
| 31.143 | −55.05° | —° |
| 31.2 | −52.18° | —° |

Table 6 shows the scanning angles obtained as well as the realized gain for three simulated values of α' (backward and forward scanning in elevation).

TABLE 6

Scanning angles and realized gain for the prototypes for backward and forward scanning respectively.

| Frequency (GHz) | Scanning range for meander stub at 35.34 mm from CST (degrees) | Realized Gain for meander stub at 35.34 mm from CST (dBi) | Scanning range for meander stub at 41.5 mm from CST (degrees) | Realized Gain for meander stub at 41.5 mm from CST (dBi) | Scanning range for meander stub at 44.3 mm from CST (degrees) | Realized Gain for meander stub at 44.3 mm from CST (dBi) |
|---|---|---|---|---|---|---|
| 30.8 | −79° | 7.93 | 12° | 14.8 | 49° | 17.4 |
| 30.857 | −75° | 10.3 | 15° | 20.3 | 53° | 16.3 |
| 30.814 | −71° | 11.4 | 19° | 22.4 | 56° | 15.6 |
| 30.871 | −68° | 14.7 | 22° | 22.6 | 60° | 15.7 |
| 31 | −64° | 15.2 | 24° | 22.6 | 64° | 15.7 |
| 31.086 | −60° | 14.7 | 27° | 22.3 | 67° | 15.5 |
| 31.143 | −57° | 14.5 | 30° | 21.3 | 70° | 15.4 |
| 31.2 | −54° | 14.1 | 32° | 20.4 | 73° | 14.8 |

Particularly, FIG. 19 shows array factors showing the theoretical scanning range obtained with a variable meander length.

The theoretical design, as described above, was applied with a fixed operational frequency and a variable meander length permit scanning from −71.09° to +71.57°. The first angle corresponds to a meander length $\alpha'_{variable}$ of 35.34 mm and the second angle to a value of 44.3 mm for $\alpha'_{variable}$. The periodicity of the elements (i.e. the separation distance between two consecutive elements) is 3.5 mm. The obtained scanning range is shown in FIG. 19.

Figure 20:
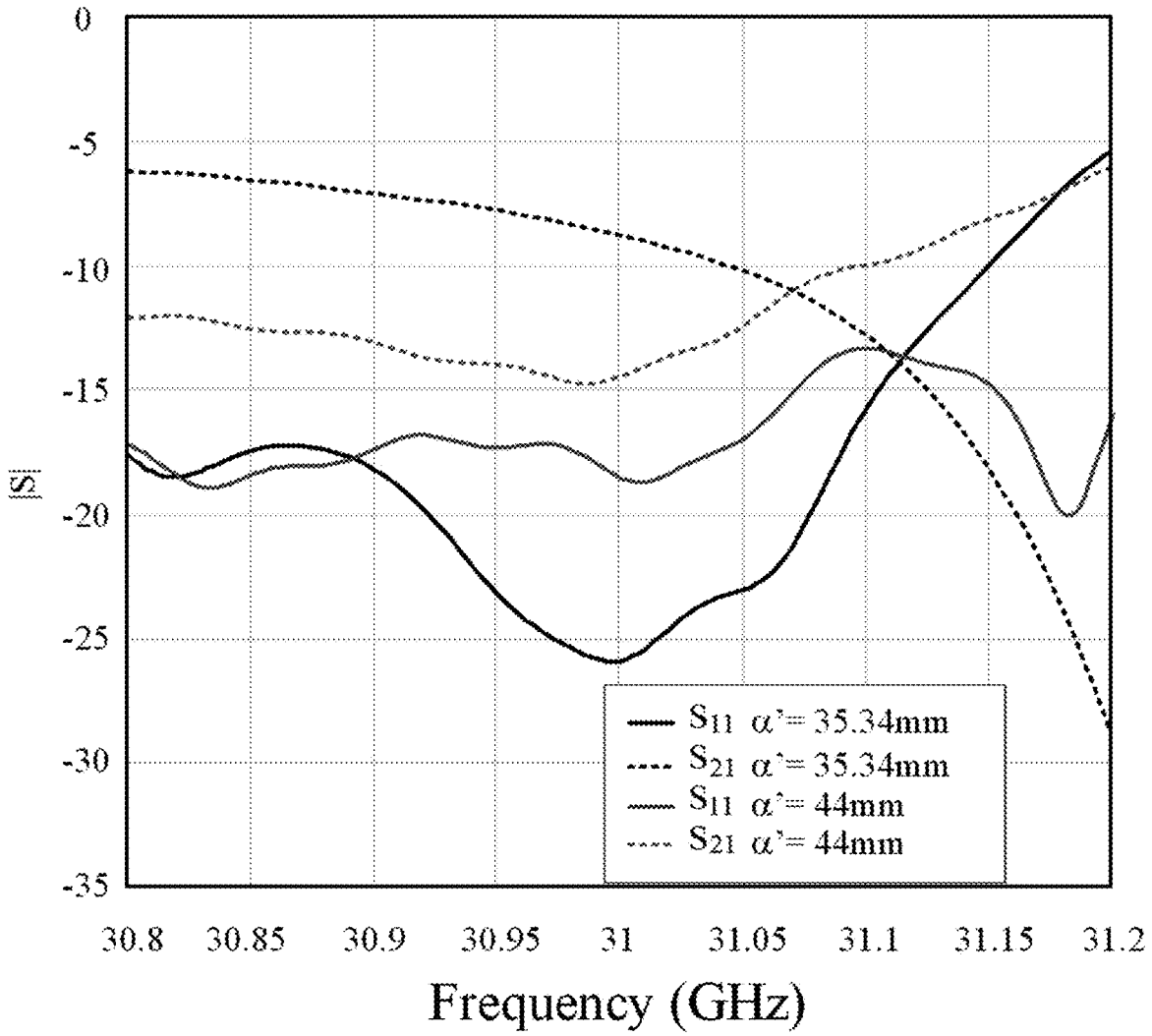
FIG. 20 schematically depicts simulated S-parameters of the prototype antenna of FIG. 13.

FIG. 20 schematically depicts simulated S-parameters of the prototype antenna of FIG. 13. Particularly, the simulated S-parameters are for a predetermined frequency of 31 Ghz, a periodicity of 3.5 mm and a variable $\alpha'_{variable}$ as described above with reference to FIG. 19.

In contrast to the simulated S-parameters described with reference to FIGS. 11A and 11B, the simulated S-parameters of the prototype antenna of FIG. 13, as shown in FIG. 20, show optimisation of the design of the prototype antenna of FIG. 13. Particularly, in the antenna of FIG. 9, the port does not change position (i.e. remains in a constant position) for different values of $\alpha'_{variable}$. However, in the antenna of FIG. 13, a position of the port changes according to $\alpha'_{variable}$, thus allowing the antenna to be matched for different values of the meander length and also for different frequencies.

Figure 21A:
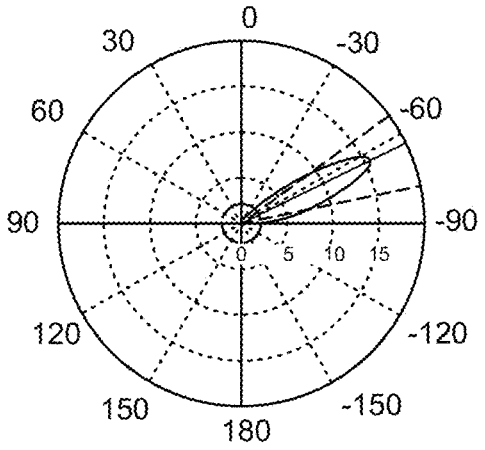
FIGS. 21A to 21B schematically depict measured radiation patterns of the prototype antenna of FIG. 13.
Figure 21B:
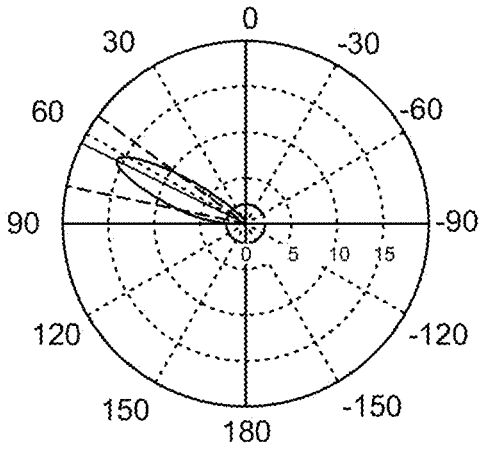

FIGS. 21A to 21B schematically depict measured radiation patterns of the prototype antenna of FIG. 13. Particularly, the measured radiation patterns are for a predetermined frequency of 31 Ghz, a periodicity of 3.5 mm and a variable $\alpha'_{variable}$, as described above with reference to FIG. 19. As shown in FIG. 21A, at a frequency of 31 GHz, fora main lobe direction of −64.0° and a main lobe magnitude of 15.2, an angular width (3 dB) of the main lobe is 24.9° and a side lobe level is −9.2 dB. As shown in FIG. 21B, at a frequency of 31 GHz, for a main lobe direction of +64.0° and a main lobe magnitude of 15.7, an angular width (3 dB) of the main lobe is 25.3° and a side lobe level is −11.4 dB.

Figure 22:
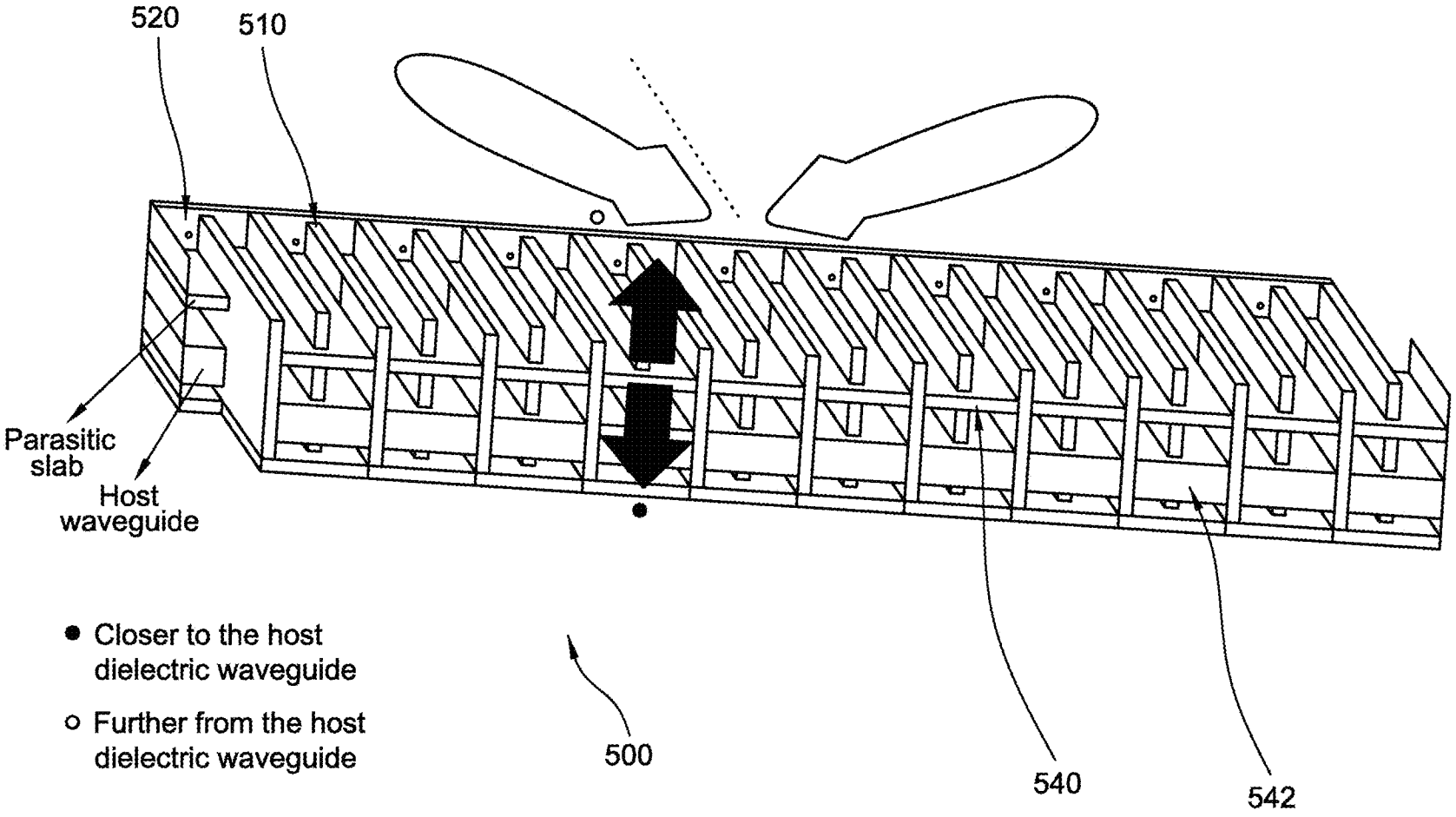
FIG. 22 schematically depicts a waveguide according to an exemplary embodiment, in use.

FIG. 22 schematically depicts a waveguide 500 according to an exemplary embodiment, in use. Particularly, FIG. 22 shows a perspective view of the waveguide 500.

The waveguide 500 is for a leaky wave antenna. The waveguide 500 comprises a male member 510 and a corresponding female member 520 arranged to receive the male member 510 therein. The waveguide is arrangeable in a first configuration and a second configuration. The male member 510 is received in the female member 520 spaced apart therefrom in the first configuration and the second configuration. The first configuration defines a first effective delay line. The second configuration defines a second effective delay line. The first effective delay line is different from the second effective delay line.

In more detail, the waveguide 500 provides a 1D transmission line. The waveguide 500 is a meandered waveguide 500, as described above with respect to the meandered waveguide 200. The waveguide comprises twenty two (i.e. a plurality) male members 510 and twenty two respective corresponding female members 520 arranged to receive the respective male members 510 therein. In this example, the waveguide 500 comprises a parasitic slab 540 arrangeable between the male member 510 and the female member 520, wherein the first effective delay line is based, at least in part, on a first dispersion provided by a first position of the parasitic slab 540 between the male member 510 and the female member 520 and wherein the second effective delay line is based, at least in part, on a second dispersion provided by a second position of the parasitic slab 540 between the male member 510 and the female member 520. Hence, scanning of the beam is by changing the position of the parasitic slab 540. Particularly, by changing the position of the parasitic slab 540 relative to the male member 510 and the female member 520, for example from a central position to a non-central position, the $TE_{10}$ mode is perturbed, thereby scanning the beam.

In this example, the waveguide 500 comprises a second, fixed parasitic slab 542.

Figure 23:
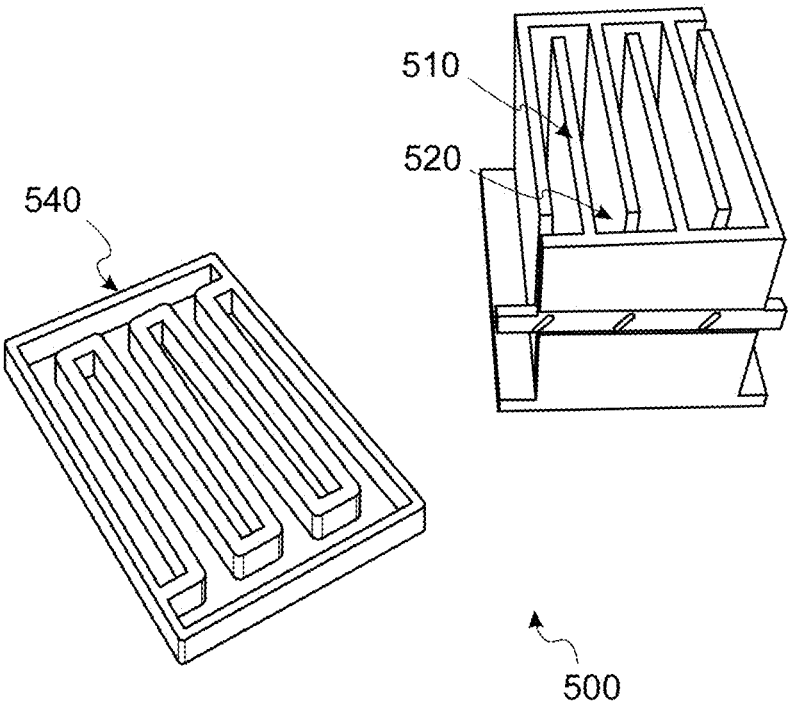
FIG. 23 schematically depicts a model of the waveguide of FIG. 22.

FIG. 23 schematically depicts a model of the waveguide 500 of FIG. 22. The prototype is a 3D printed model of the waveguide 500, to demonstrate structural arrangement rather than operation.

Figure 24A:
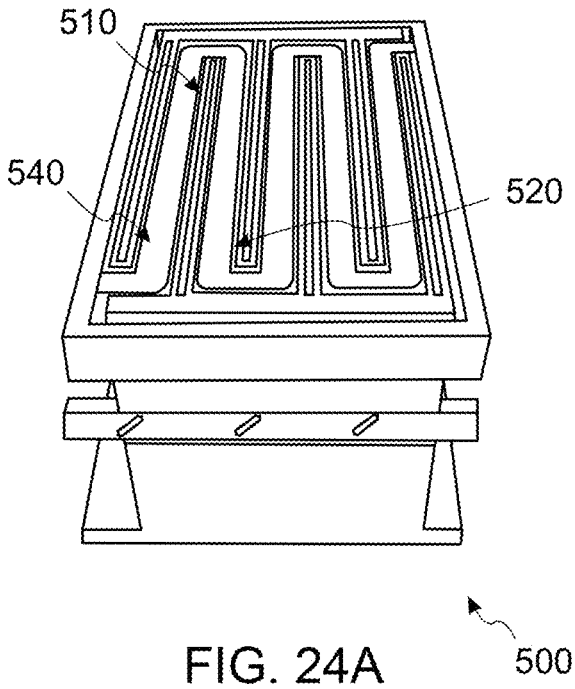
FIGS. 24A to 24B schematically depicts the model of FIG. 23, in use.
Figure 24B:
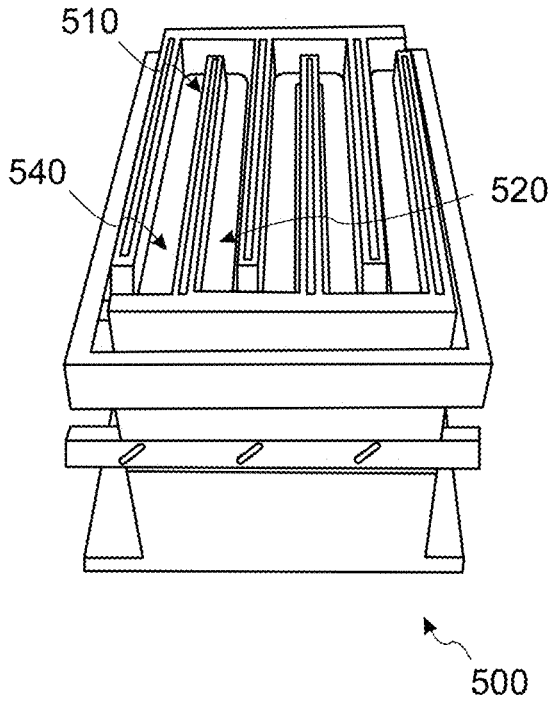

FIGS. 24A to 22B schematically depicts the model waveguide of FIG. 23, in use. Particularly, FIG. 24A shows a perspective view of the waveguide 500, in use, in the first configuration and FIG. 24B shows a perspective view of the waveguide 500, in use, in the second configuration.

Figure 25:
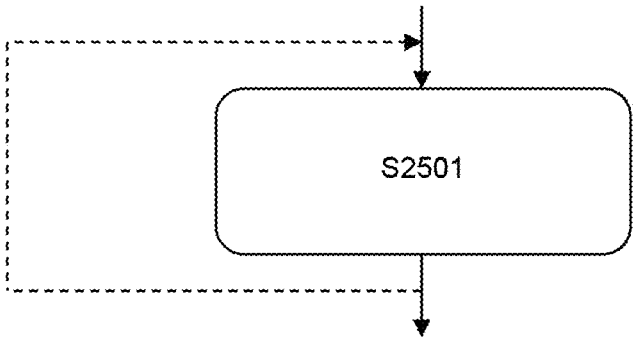
FIG. 25 schematically depicts a method of according to an exemplary embodiment.

FIG. 25 schematically depicts a method of according to an exemplary embodiment.

Particularly, FIG. 25 schematically depicts the method of controlling the leaky wave antenna 10, 20 to scan a beam having a predetermined frequency in an elevation plane.

At S2501, the first actuator 11, 21 is actuated, thereby moving the first waveguide 100, 200, 300, 400, 500 from the first configuration to the second configuration.

Optionally, step S2501 may be repeated one or more times.

The method may include any of the steps described herein.

Figure 26:
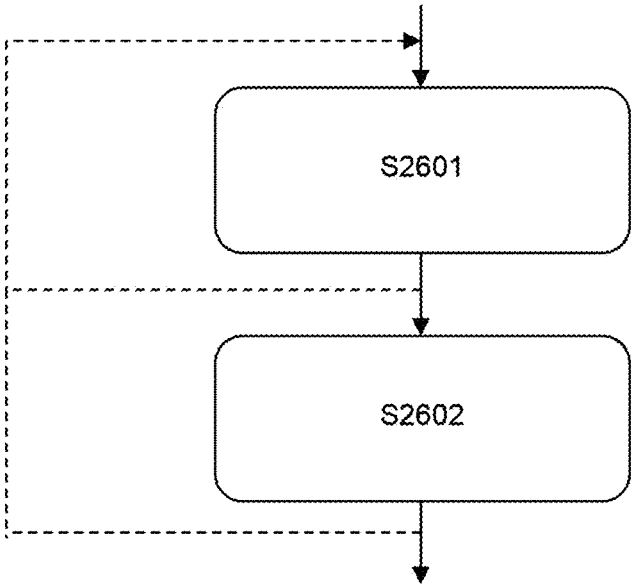
FIG. 26 schematically depicts a method of according to an exemplary embodiment.

FIG. 26 schematically depicts a method of according to an exemplary embodiment.

Particularly, FIG. 26 schematically depicts the method of controlling a leaky wave antenna 10, 20 to scan a beam having a predetermined frequency in an elevation plane and an azimuthal plane.

At S2601, the first actuator 11, 21 is actuated, thereby moving the first waveguide 100A, 200A, 300A, 400A, 500A from the first configuration to the second configuration.

At S2602, the first phase shifter 22 is adjusted, thereby controlling the phase difference between the first waveguide 1 ODA, 200A, 300A, 400A, SODA and the second waveguide 100B, 200B,300B,400B,500B.

Optionally, steps S2401 and/or S2402 may be repeated one or more times.

The method may include any of the steps described herein.

Figure 27:
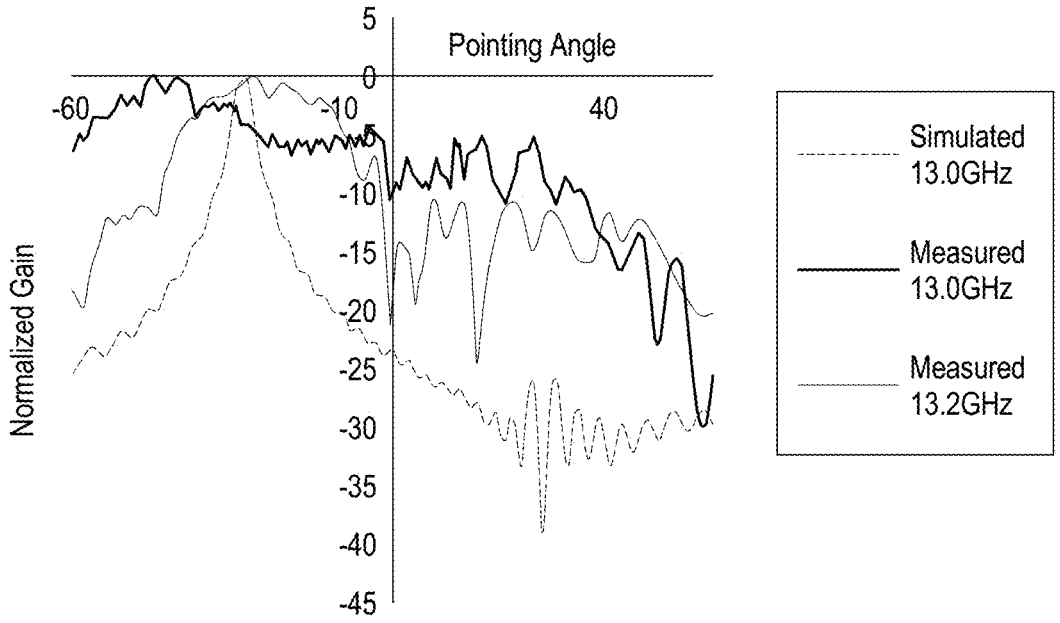
FIG. 27 shows a graph of normalized gain as a function of angle for a 1D antenna according to an exemplary embodiment having a fixed elevation angle of −30° for a simulated model thereof at 13.0 GHz and as measured at 13.0 GHz and at 13.2 GHz.

FIG. 27 shows a graph of normalized gain as a function of angle for a first 1D antenna TD #1 according to an exemplary embodiment having a fixed elevation angle of −30° (i.e. a static 1D antenna) for a simulated model thereof at 13.0 GHz and as measured at 13.0 GHz and at 13.2 GHz.

Figure 28:
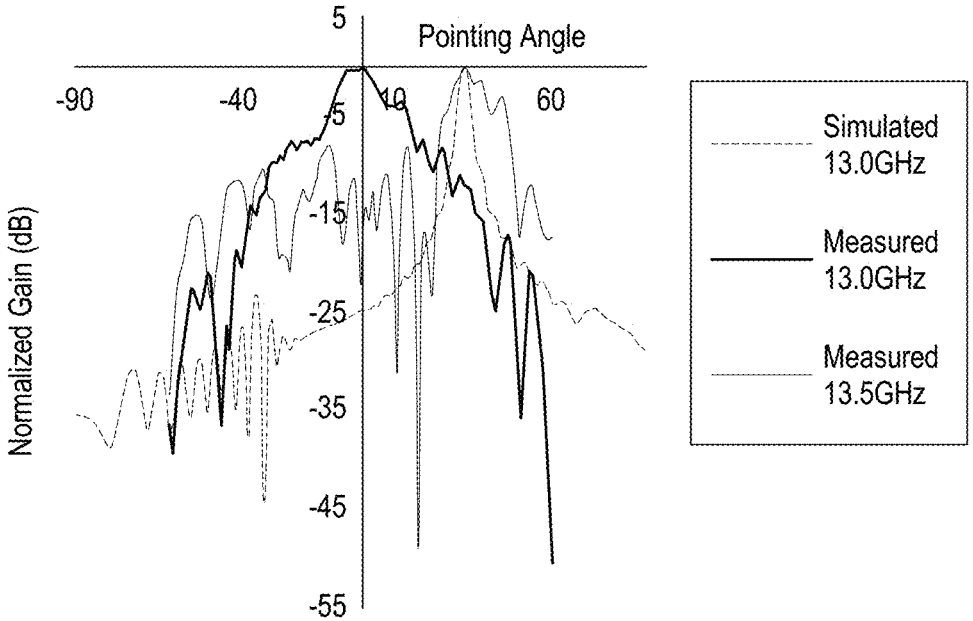
FIG. 28 shows a graph of normalized gain as a function of angle for a 1D antenna according to an exemplary embodiment having a fixed elevation angle of +30° for a simulated model thereof at 13.0 GHz and as measured at 13.0 GHz and at 13.2 GHz.

FIG. 28 shows a graph of normalized gain as a function of angle for a second 1D antenna TD #2 according to an exemplary embodiment having a fixed elevation angle of +30° (i.e. a static 1D antenna) for a simulated model thereof at 13.0 GHz and as measured at 13.0 GHz and at 13.2 GHz.

The first and second antennas, TD #1 and TD #2, are static antennas, having fixed elevation angles (also known as pointing angles) of −30° and +30°, respectively, by virtue of having corresponding fixed and different meander lengths. The function of angle is measured with respect to the Z-axis, in which the respective antennae are lying on the XY-plane with the aperture face facing towards +Z-axis.

Figure 29:
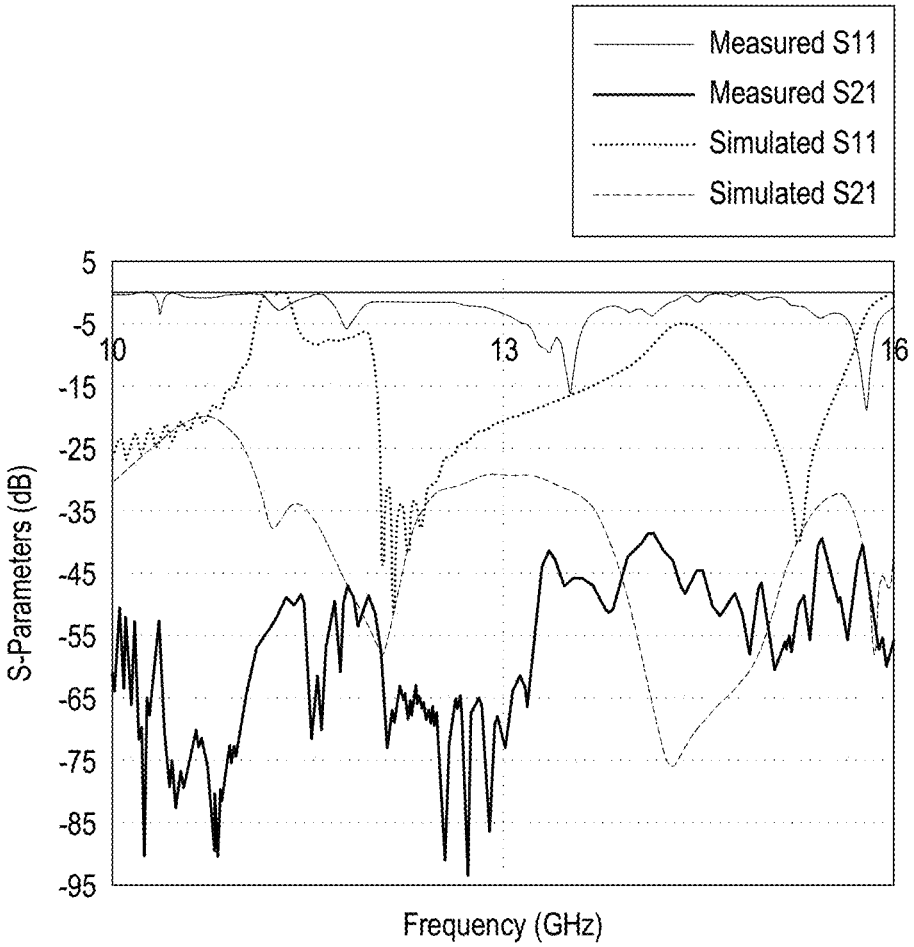
FIG. 29 shows a graph of S-parameters (S11 and S21) as a function of frequency for the simulated models and as measured for the prototypes of FIGS. 27 and 28.

FIG. 29 shows a graph of S-parameters (S11 and S21) as a function of frequency for the simulated models and as measured for the first and second prototypes of FIGS. 27 and 28.

Although a preferred embodiment has been shown and described, it will be appreciated by those skilled in the art that various changes and modifications might be made without departing from the scope of the invention, as defined in the appended claims and as described above.

In summary, the invention provides a waveguide for a leaky wave antenna and a leaky wave antenna comprising such a waveguide. By changing an effective delay line of the waveguide, for example by changing a meander line length or by moving a parasitic slab, elevation scanning of the antenna may be provided. Furthermore, by including a single phase shifter per waveguide, azimuth scanning of the antenna may be additionally provided.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims and drawings), and/or all of the steps of any method or process so disclosed, may be combined in any combination, except combinations where at most some of such features and/or steps are mutually exclusive.

Each feature disclosed in this specification (including any accompanying claims, and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims and drawings), or to any novel one, or any novel combination, of the steps of any method or process so disclosed.

The invention claimed is:

1. A meandered slotted waveguide, for a leaky wave antenna, the meandered slotted waveguide comprising:

a male member; and a corresponding female member arranged to receive the male member therein;

wherein the meandered slotted waveguide is arrangeable in a first configuration and a second configuration;

wherein the male member is received in the female member spaced apart therefrom in the first configuration and the second configuration;

wherein the first configuration defines a first effective delay line having a first meander line length;

wherein the second configuration defines a second effective delay line having a second meander line length;

wherein the first effective delay line is different from the second effective delay line and the first meander line length is different from the second meander line length;

wherein the male member is a planar male member and the female member is a planar female member;

wherein the meandered slotted waveguide comprises a plurality N of such male members and a plurality M of such corresponding female members configured to receive the plurality N of male members therein, respectively;

wherein the meandered slotted waveguide is arranged to move from the first configuration to the second configuration by simultaneous translation of the plurality N of male members relative to the plurality M of female members.

2. The meandered slotted waveguide according to claim 1, wherein the translation is in a direction defined by a longitudinal axis of the male member or the female member.

3. The meandered slotted waveguide according to 1, wherein the meandered slotted waveguide comprises a parasitic slab arrangeable between the male member and the female member, wherein the first effective delay line is based, at least in part, on a first dispersion provided by a first position of the parasitic slab between the male member and the female member and wherein the second effective delay line is based, at least in part, on a second dispersion provided by a second position of the parasitic slab between the male member and the female member.

4. The meandered slotted waveguide according to claim 3, wherein the meandered slotted waveguide is arranged to move from the first configuration to the second configuration by a translation of the parasitic slab relative to the male member or the female member.

5. The meandered slotted waveguide according to claim 4, wherein the translation of the parasitic slab is in a direction transverse to a longitudinal axis of the male member or the female member.

6. The meandered slotted waveguide according to claim 1, wherein lateral spacings between the male member received in the female member in the first configuration and in the second configuration are constant.

7. The meandered slotted waveguide according to claim 1, wherein the meandered slotted waveguide comprises a first part including one of the plurality N of male members and a second part including the remaining plurality N of male members, wherein the first part is moveable with respect to the second part.

8. The meandered slotted waveguide according to claim 7, wherein the first part includes a first half of the plurality N of male members and the second part includes a second half of the plurality N of male members.

9. A leaky wave antenna comprising:

a first meandered slotted waveguide according to claim 1; and a first actuator arranged to move the first meandered slotted waveguide from the first configuration to the second configuration;

wherein the leaky wave antenna is arranged to scan a beam having a predetermined frequency in an elevation plane by actuating the first actuator, thereby moving the first meandered slotted waveguide from the first configuration to the second configuration.

10. The leaky wave antenna according to claim 9, comprising: a second meandered slotted waveguide, for the leaky wave antenna, the second meandered slotted waveguide comprising: a second male member; and a corresponding second female member arranged to receive the second male member therein; wherein the second meandered slotted waveguide is arrangeable in the first configuration and the second configuration; wherein the second male member is received in the second female member spaced apart therefrom in the first configuration and the second configuration; wherein the first configuration of the second meandered slotted waveguide defines a third effective delay line having a third meander line length and the second configuration of the second meandered slotted waveguide defines a fourth effective delay line having a fourth meander line length; wherein the third effective delay line is different from the fourth effective delay line and the third meander line length is different from the fourth meander line length; wherein the second male member is a second planar male member and the second female member is a second planar female member; wherein the second meandered slotted waveguide comprises a second plurality N of such second male members and a second plurality M of such corresponding second female members configured to receive the second plurality N of second male members therein, respectively; wherein the second meandered slotted waveguide is arranged to move from the first configuration to the second configuration by simultaneous translation of the second plurality N of second male members relative to the second plurality M of second female members; and a second actuator arranged to move the second meandered slotted waveguide from the first configuration to the second configuration; wherein the leaky wave antenna is arranged to scan the beam having the predetermined frequency in the elevation plane by actuating the second actuator, thereby moving the second meandered slotted waveguide from the first configuration to the second configuration.

11. The leaky wave antenna according to claim 10, wherein the first actuator and the second actuator are actuated simultaneously.

12. The leaky wave antenna according to claim 9, wherein the first actuator comprises a micropusher.

13. The leaky wave antenna according to claim 10, wherein the leaky wave antenna comprises a first phase shifter associated with the first meandered slotted waveguide, wherein the first phase shifter is arranged to control, at least in part, a phase difference between the first meandered slotted waveguide and the second meandered slotted waveguide whereby the leaky wave antenna is arranged to scan the beam having the predetermined frequency in an azimuthal plane.

14. The leaky wave antenna according to claim 10, wherein the leaky wave antenna comprises a second phase shifter associated with the second meandered slotted waveguide, wherein the second phase shifter is arranged to control, at least in part, a phase difference between the first meandered slotted waveguide and the second meandered slotted waveguide whereby the leaky wave antenna is arranged to scan the beam having the predetermined frequency in an azimuthal plane.

15. A method of controlling a leaky wave antenna according to claim 9 to scan a beam having a predetermined frequency in an elevation plane, the method comprising:

actuating the first actuator, thereby moving the first meandered slotted waveguide from the first configuration to the second configuration.

16. A method of controlling a leaky wave antenna according to claim 13 to scan a beam having a predetermined frequency in an elevation plane and an azimuthal plane, the method comprising:

actuating the first actuator, thereby moving the first meandered slotted waveguide from the first configuration to the second configuration; and adjusting the first phase shifter thereby controlling the phase difference between the first meandered slotted waveguide and the second meandered slotted waveguide.

* * * * *